US011735095B2

(12) United States Patent
Seo et al.

(10) Patent No.: US 11,735,095 B2
(45) Date of Patent: Aug. 22, 2023

(54) ELECTRONIC APPARATUS AND CONTROLLING METHOD THEREOF

(71) Applicant: Samsung Electronics Co., Ltd., Suwon-si (KR)

(72) Inventors: Gaewon Seo, Suwon-si (KR); Sungchang Jang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/691,726

(22) Filed: Mar. 10, 2022

(65) Prior Publication Data

US 2022/0262298 A1 Aug. 18, 2022

Related U.S. Application Data

(63) Continuation of application No. PCT/KR2021/019976, filed on Dec. 28, 2021.

(30) Foreign Application Priority Data

Feb. 8, 2021 (KR) ..... 10-2021-0017723
May 7, 2021 (KR) ..... 10-2021-0059488

(51) Int. Cl.
*G09G 3/20* (2006.01)

(52) U.S. Cl.
CPC ... *G09G 3/2096* (2013.01); *G09G 2340/0407* (2013.01); *G09G 2354/00* (2013.01); (Continued)

(58) Field of Classification Search
CPC ..... G09G 3/2096; G09G 2340/0407; G09G 2354/00; G09G 2370/042; G09G 2370/20; G09G 2370/22; G09G 2320/08
See application file for complete search history.

(56) References Cited

U.S. PATENT DOCUMENTS 8,502,845 B2 8/2013 Kim
8,644,671 B2 2/2014 Song
(Continued)

FOREIGN PATENT DOCUMENTS

EP 3 574 392 1/2019
JP 2008-067024 A 3/2008
(Continued)

OTHER PUBLICATIONS

International Search Report with written opinion dated May 2, 2022, issued in International Patent Application No. PCT/KR2021/019976.

*Primary Examiner* — Brent D Castiaux
(74) *Attorney, Agent, or Firm* — Jefferson IP Law, LLP

(57) ABSTRACT

An electronic apparatus is provided. The electronic apparatus includes an input/output interface connected to a source apparatus, a display, and a processor configured to, based on detecting that the source apparatus is connected through the input/output interface, receive identification information of the source apparatus from the source apparatus, and based on the received identification information of the source apparatus, control the display to display a user interface (UI) for changing a resolution, and based on receiving a user input for changing a resolution through the displayed UI, identify whether the source apparatus can transmit a content of the resolution corresponding to the user input based on the identification information of the source apparatus, and based on identifying that the source apparatus can transmit a content of the resolution corresponding to the user input, transmit a signal requesting the content of the resolution corresponding to the user input to the source apparatus.

19 Claims, 22 Drawing Sheets

(52) U.S. Cl.
CPC ... *G09G 2370/042* (2013.01); *G09G 2370/20* (2013.01); *G09G 2370/22* (2013.01)

(56) References Cited

U.S. PATENT DOCUMENTS

| | | | | |
|---|---|---|---|---|
| 10,916,217 | B2 | 2/2021 | Oh | |
| 2008/0094525 | A1 | 4/2008 | Song | |
| 2011/0193898 | A1 | 8/2011 | Kim | |
| 2014/0211941 | A1* | 7/2014 | Oh | H04N 21/4367 380/201 |
| 2017/0013231 | A1* | 1/2017 | Kwon | H04N 21/4363 |
| 2017/0132749 | A1* | 5/2017 | Lim | G06T 1/20 |
| 2018/0226052 | A1* | 8/2018 | Lv | G09G 5/006 |
| 2021/0035537 | A1 | 2/2021 | Shih et al. | |

FOREIGN PATENT DOCUMENTS

| | | | |
|---|---|---|---|
| JP | 2015-165617 | A | 9/2015 |
| JP | 2017-192000 | A | 10/2017 |
| KR | 10-2008-0035838 | A | 4/2008 |
| KR | 10-2009-0011876 | A | 2/2009 |
| KR | 10-2011-0091281 | A | 8/2011 |
| KR | 10-1296622 | B1 | 8/2013 |
| KR | 10-2014-0021191 | A | 2/2014 |
| KR | 10-1499980 | B1 | 3/2015 |
| KR | 10-2016-0026075 | A | 3/2016 |
| KR | 10-2017-0006576 | A | 1/2017 |
| KR | 10-2019-0129579 | A | 11/2019 |

* cited by examiner

FIG. 10

1005

| IDENTIFICATION INFORMATION | INFORMATION ON RESOLUTIONS THAT CAN BE SUPPORTED | SCALING FUNCTION |
|---|---|---|
| A-01 | QHD | X |
| A-02 | QHD | O |
| A-03 | UHD(4K) | X |
| A-04 | UHD(4K) | O |
| B-01 | FHD, QHD, UHD(4K), FUHD(8K) | O |

ELECTRONIC APPARATUS AND CONTROLLING METHOD THEREOF

CROSS-REFERENCE TO RELATED APPLICATION(S)

This application is a continuation application, claiming priority under § 365(c), of an International Application No. PCT/KR2021/019976, filed on Dec. 28, 2021, which is based on and claims the benefit of a Korean patent application number 10-2021-0017723, filed on Feb. 8, 2021, and of a Korean patent application number 10-2021-0059488, filed on May 7, 2021, in the Korean Intellectual Property Office, the disclosure of each of which is incorporated by reference herein in its entirety.

TECHNICAL FIELD

The disclosure relates to an electronic apparatus and a controlling method thereof. More particularly, the disclosure relates to an electronic apparatus that determines whether a source apparatus can support a resolution to which a user requested to change in response to the user's request for changing a resolution, and a controlling method thereof.

BACKGROUND ART

A source apparatus that provides a content and a sync apparatus that displays the provided content may be connected. The source apparatus may transmit a content of a specific resolution to the sync apparatus based on a resolution of a display included in the sync apparatus.

A user may attempt to change the resolution at the sync apparatus. There may be a situation wherein the resolution currently provided at the sync apparatus is a first resolution, and the user changes the resolution to a second resolution different from the first resolution. Even if the user inputs an instruction to change the resolution to the second resolution, the source apparatus may not support or provide the second resolution.

In case the second resolution selected by the user is not provided at the source apparatus, the source apparatus may not provide a content of the second resolution to the sync apparatus, and the sync apparatus may not display the content of the second resolution according to the request of the user. This may vary according to information on resolutions that the source apparatus can provide.

There is a problem that, in case the user selected the second resolution, the sync apparatus can display a content of the second resolution if a source apparatus that supports the second resolution is connected, but if a source apparatus that does not support the second resolution is connected, the sync apparatus cannot display a content of the second resolution.

In this case, there is a problem that it is difficult for the user to intuitively figure out what are the resolutions supported by the source apparatus currently connected to the sync apparatus. Also, there is a problem that it is difficult for the user to determine whether a resolution that the user selected can be directly scaled at the source apparatus.

The above information is presented as background information only to assist with an understanding of the disclosure. No determination has been made, and no assertion is made, as to whether any of the above might be applicable as prior art with regard to the disclosure.

DISCLOSURE

Technical Problem

Aspects of the disclosure are to address at least the above-mentioned problems and/or disadvantages and to provide at least the advantages described below. Accordingly, an aspect of the disclosure is to provide an electronic apparatus that determines whether a source apparatus can transmit a content of a resolution to which a user requested to change by using pre-stored information of the source apparatus, and a controlling method thereof.

Additional aspects will be set forth in part in the description which follows and, in part, will be apparent from the description, or may be learned by practice of the presented embodiments.

Technical Solution

In accordance with an aspect of the disclosure, an electronic apparatus for achieving the aforementioned purpose is provided. The electronic apparatus includes an input/output interface connected to a source apparatus, a display, and a processor configured to, based on detecting that the source apparatus is connected through the input/output interface, receive identification information of the source apparatus from the source apparatus, and based on the received identification information of the source apparatus, control the display to display a user interface (UI) for changing a resolution, and based on receiving a user input for changing a resolution through the displayed UI, identify whether the source apparatus can transmit a content of the resolution corresponding to the user input based on the identification information of the source apparatus, and based on identifying that the source apparatus can transmit a content of the resolution corresponding to the user input, transmit a signal requesting the content of the resolution corresponding to the user input to the source apparatus through the input/output interface. Meanwhile, the electronic apparatus further includes a memory storing extended display identification data (EDID) information corresponding to the electronic apparatus, wherein the processor may, based on identifying that the source apparatus can transmit a content of the resolution corresponding to the user input, change the EDID information based on the resolution corresponding to the user input, and based on identifying that the source apparatus cannot transmit a content of the resolution corresponding to the user input, scale the content received from the source apparatus to the resolution corresponding to the user input, and control the display to display the scaled content.

Meanwhile, the processor may, based on the EDID information changing, transmit a signal for notifying that the EDID information was changed to the source apparatus, receive a content corresponding to the changed EDID information from the source apparatus, and control the display to display the content received from the source apparatus.

Meanwhile, the signal for notifying that the EDID information was changed may be a signal changing a hot plug detect signal from a low state to a high state.

Meanwhile, the electronic apparatus further includes a memory storing a table wherein identification information of a plurality of source apparatuses and resolution information corresponding to the respective identification information are mapped, wherein the processor may identify resolution information corresponding to the identification information of the source apparatus based on the table stored in the memory, and identify whether the source apparatus can transmit a content of the resolution corresponding to the user input based on the identified resolution information.

Meanwhile, the input/output interface may be a high definition multimedia interface (HDMI), and the processor may, based on the source apparatus being connected through the input/output interface, acquire the identification information of the source apparatus from the source apparatus.

Meanwhile, the processor may identify whether the source apparatus can scale a content based on the identification information of the source apparatus, and based on identifying that the source apparatus can scale a content, transmit a signal requesting the content of the resolution corresponding to the user input to the source apparatus, and based on identifying that the source apparatus cannot scale a content, scale the content received from the source apparatus to the resolution corresponding to the user input.

Meanwhile, the UI may be a UI for selecting one resolution among a plurality of resolutions, and the processor may, based on receiving a user input selecting one resolution through the displayed UI, identify whether the source apparatus can transmit a content of the resolution corresponding to the user input based on the identification information of the source apparatus.

Meanwhile, the processor may identify a plurality of resolutions that can be displayed on the display based on resolution information of the display, and control the display to display the UI for selecting one resolution among the plurality of identified resolutions.

Meanwhile, the processor may, based on identifying that the source apparatus cannot transmit a content of the resolution corresponding to the user input, control the display to display a UI including at least one of information notifying that the source apparatus cannot transmit a content of the resolution corresponding to the user input, the identification information of the source apparatus, the resolution information of the source apparatus, or information for guiding such that the content received from the source apparatus is scaled to the resolution corresponding to the user input at the electronic apparatus.

In accordance with another aspect of the disclosure, a controlling method of an electronic apparatus connected to a source apparatus is provided. The controlling method includes the steps of, based on detecting that the source apparatus is connected, receiving identification information of the source apparatus from the source apparatus, and based on the received identification information of the source apparatus, displaying a UI for changing a resolution, and based on receiving a user input for changing a resolution through the displayed UI, identifying whether the source apparatus can transmit a content of the resolution corresponding to the user input based on the identification information of the source apparatus, and based on identifying that the source apparatus can transmit a content of the resolution corresponding to the user input, transmitting a signal requesting the content of the resolution corresponding to the user input to the source apparatus through the input/output interface.

Meanwhile, the controlling method may further include the steps of, based on identifying that the source apparatus can transmit a content of the resolution corresponding to the user input, changing extended display identification data (EDID) information corresponding to the electronic apparatus based on the resolution corresponding to the user input, and based on identifying that the source apparatus cannot transmit a content of the resolution corresponding to the user input, scaling the content received from the source apparatus to the resolution corresponding to the user input, and displaying the scaled content.

Meanwhile, the controlling method may further include the steps of, based on the EDID information changing, transmitting a signal for notifying that the EDID information was changed to the source apparatus, receiving a content corresponding to the changed EDID information from the source apparatus, and displaying the content received from the source apparatus.

Meanwhile, the signal for notifying that the EDID information was changed may be a signal changing a hot plug detect signal from a low state to a high state.

Meanwhile, in the step of identifying whether the source apparatus can transmit a content of the resolution corresponding to the user input, resolution information corresponding to the identification information of the source apparatus may be identified based on a table wherein identification information of a plurality of source apparatuses stored in the electronic apparatus and resolution information corresponding to the respective identification information are mapped, and it may be identified whether the source apparatus can transmit a content of the resolution corresponding to the user input based on the identified resolution information.

Meanwhile, the input/output interface of the electronic apparatus may be a high definition multimedia interface (HDMI). Meanwhile, the controlling method may further include the step of, based on the source apparatus being connected through the input/output interface, acquiring the identification information of the source apparatus from the source apparatus.

Meanwhile, the controlling method may further include the steps of identifying whether the source apparatus can scale a content based on the identification information of the source apparatus, and based on identifying that the source apparatus can scale a content, transmitting a signal requesting the content of the resolution corresponding to the user input to the source apparatus, and based on identifying that the source apparatus cannot scale a content, scaling the content received from the source apparatus to the resolution corresponding to the user input.

Meanwhile, the UI may be a UI for selecting one resolution among a plurality of resolutions, and in the step of identifying whether the source apparatus can transmit a content of the resolution corresponding to the user input, based on receiving a user input selecting one resolution through the displayed UI, it may be identified whether the source apparatus can transmit a content of the resolution corresponding to the user input based on the identification information of the source apparatus.

Meanwhile, the controlling method may further include the steps of identifying a plurality of resolutions that can be displayed on the display based on resolution information of the display included in the electronic apparatus, and displaying the UI for selecting one resolution among the plurality of identified resolutions.

Meanwhile, the controlling method may further include the step of, based on identifying that the source apparatus cannot transmit a content of the resolution corresponding to the user input, displaying a UI including at least one of information notifying that the source apparatus cannot transmit a content of the resolution corresponding to the user input, the identification information of the source apparatus, the resolution information of the source apparatus, or information for guiding such that the content received from the source apparatus is scaled to the resolution corresponding to the user input at the electronic apparatus.

Other aspects, advantages, and salient features of the disclosure will become apparent to those skilled in the art from the following detailed description, which, taken in conjunction with the annexed drawings, discloses various embodiments of the disclosure.

DESCRIPTION OF DRAWINGS

The above and other aspects, features, and advantages of certain embodiments of the disclosure will be more apparent from the following description taken in conjunction with the accompanying drawings, in which:

FIG. 10 is a diagram for illustrating a table including information related to the source apparatus according to an embodiment of the disclosure;

The same reference numerals are used to represent the same elements throughout the drawings.

MODE FOR INVENTION

Figure 1:
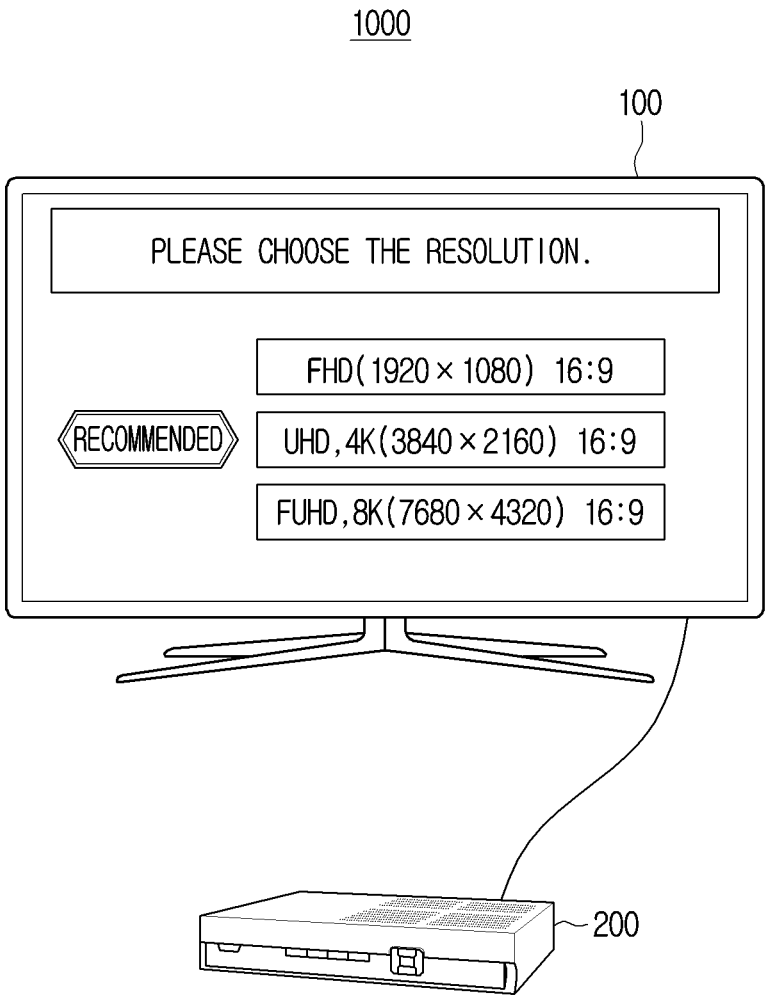
FIG. 1 is a diagram for illustrating a content providing system according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

As terms used in the embodiments of the disclosure, general terms that are currently used widely were selected as far as possible, in consideration of the functions described in the disclosure. However, the terms may vary depending on the intention of those skilled in the art who work in the pertinent technical field or previous court decisions, emergence of new technologies, etc. Also, in particular cases, there may be terms that were arbitrarily designated by the applicant, and in such cases, the meaning of the terms will be described in detail in the relevant descriptions in the disclosure. Accordingly, the terms used in the disclosure should be defined based on the meaning of the terms and the overall content of the disclosure, but not just based on the names of the terms.

Also, in this specification, expressions such as "have," "may have," "include," and "may include" denote the existence of such characteristics (e.g.: elements such as numbers, functions, operations, and components), and do not exclude the existence of additional characteristics.

In addition, the expression "at least one of A and/or B" should be interpreted to mean any one of "A" or "B" or "A and B."

Further, the expressions "first," "second" and the like used in this specification may be used to describe various elements regardless of any order and/or degree of importance. In addition, such expressions are used only to distinguish one element from another element, and are not intended to limit the elements.

Also, the description in the disclosure that one element (e.g.: a first element) is "(operatively or communicatively) coupled with/to" or "connected to" another element (e.g.: a second element) should be interpreted to include both the case where the one element is directly coupled to the another element, and the case where the one element is coupled to the another element through still another element (e.g.: a third element).

Also, in the disclosure, terms such as "include" and "consist of" should be construed as designating that there are such characteristics, numbers, steps, operations, elements, components, or a combination thereof described in the specification, but not as excluding in advance the existence or possibility of adding one or more of other characteristics, numbers, steps, operations, elements, components, or a combination thereof.

Further, in the disclosure, "a module" or "a part" performs at least one function or operation, and may be implemented as hardware or software, or as a combination of hardware and software. Also, a plurality of "modules" or "parts" may be integrated into at least one module and implemented as at least one processor (not shown), except "modules" or "parts" which need to be implemented as specific hardware.

Also, in this specification, the term "user" may refer to a person who uses an electronic apparatus or an apparatus using an electronic apparatus (e.g.: an artificial intelligence electronic apparatus).

Hereinafter, an embodiment of the disclosure will be described in more detail with reference to the accompanying drawings.

FIG. 1 is a diagram for illustrating a content providing system according to an embodiment of the disclosure.

Referring to FIG. 1, a system 1000 may include an electronic apparatus 100 and a source apparatus 200.

The electronic apparatus 100 may mean an apparatus that includes a display and displays contents. For example, the electronic apparatus 100 may mean a TV.

The source apparatus 200 may mean an apparatus that is connected with the electronic apparatus 100 via wire or wirelessly, and provides contents to the electronic apparatus 100. The source apparatus 200 may mean a set-top box, a game console, a personal computer (PC), etc.

The source apparatus 200 may store contents in a memory of the source apparatus 200, and the source apparatus 200 may provide stored contents to the electronic apparatus 100 according to a request of the electronic apparatus 100. The source apparatus 200 may provide the stored contents to the electronic apparatus 100 by itself, without using a separate external server (not shown).

Figure 2:
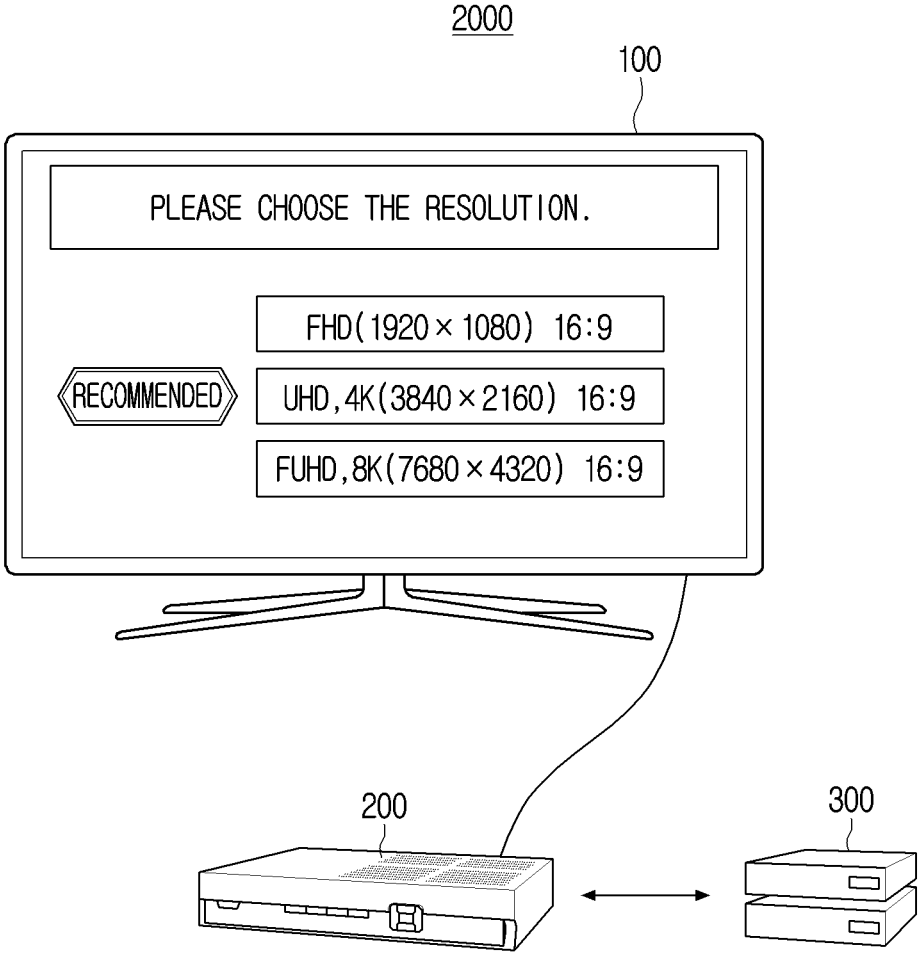
FIG. 2 is a diagram for illustrating a content providing system according to an embodiment of the disclosure.

FIG. 2 is a diagram for illustrating a content providing system according to an embodiment of the disclosure.

Referring to FIG. 2, a system 2000 may include an electronic apparatus 100, a source apparatus 200, and an external server 300.

The external server 300 may mean a web server or a database server that provides contents to a plurality of source apparatuses. The electronic apparatus 100 may transmit a signal requesting a specific content to the source apparatus 200, and the source apparatus 200 may transmit the received signal requesting a specific content to the external server 300. The external server 300 may provide the specific content to the source apparatus 200 according to the request of the source apparatus 200, and the source apparatus 200 may transmit the provided specific content to the electronic apparatus 100.

Figure 3:
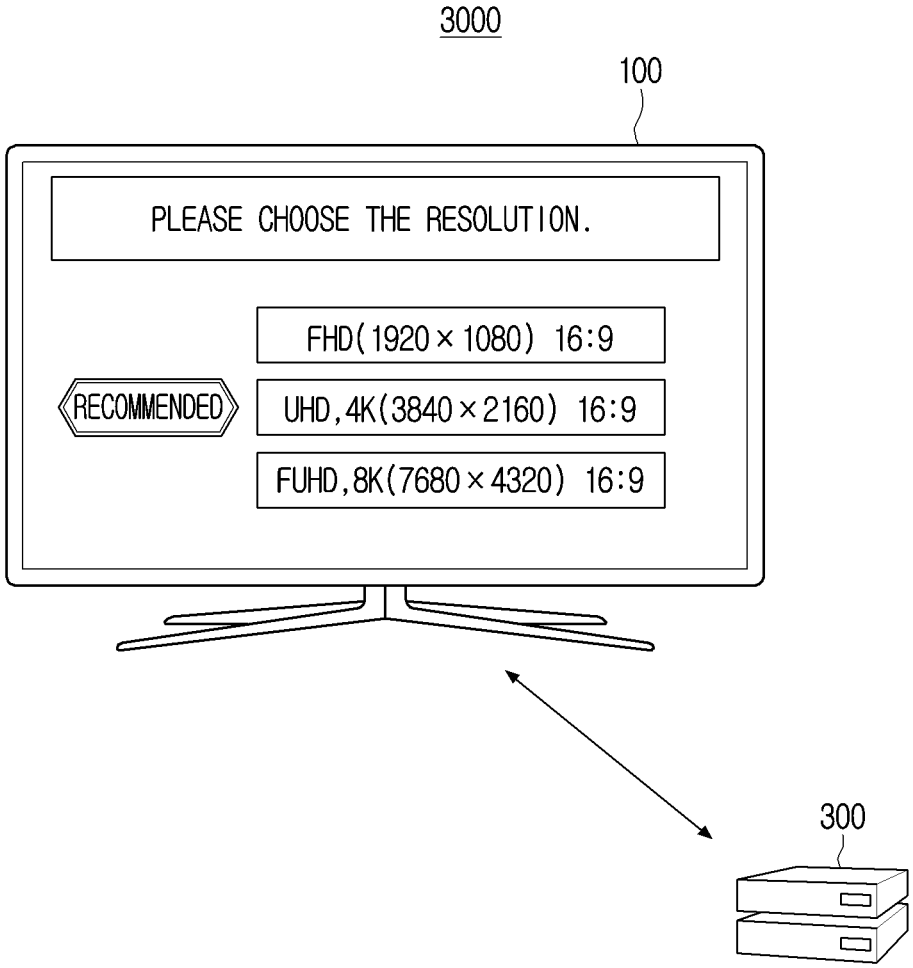
FIG. 3 is a diagram for illustrating a content providing system according to an embodiment of the disclosure.

FIG. 3 is a diagram for illustrating a content providing system according to an embodiment of the disclosure.

Referring to FIG. 3, a system 3000 may include an electronic apparatus 100 and an external server 300.

The electronic apparatus 100 may be directly connected with the external server 300 not via a separate source apparatus 200. Specifically, the electronic apparatus 100 may request a specific content to the external server 300, and the external server 300 may provide the specific content to the electronic apparatus 100. The external server 300 may directly perform the functions of the source apparatus 200 in FIGS. 1 and 2. Accordingly, the external server 300 may directly perform various operations performed in the source apparatus 200.

Figure 4:
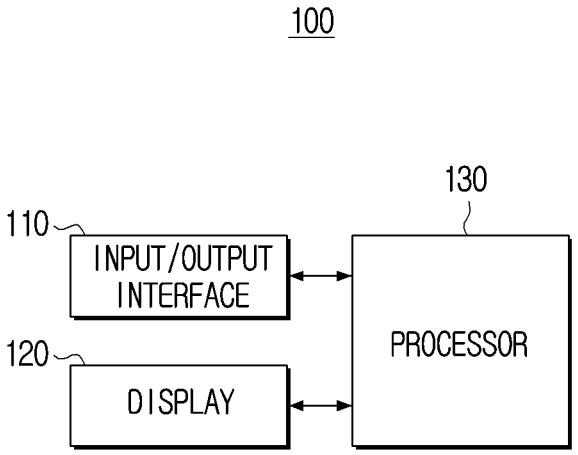
FIG. 4 is a block diagram illustrating an electronic apparatus according to an embodiment of the disclosure.

FIG. 4 is a block diagram illustrating an electronic apparatus according to an embodiment of the disclosure.

Referring to FIG. 4, the electronic apparatus 100 may consist of an input/output interface 110, a display 120, and a processor 130.

The input/output interface 110 may be an interface of any one of a high definition multimedia interface (HDMI), a mobile high-definition link (MHL), a universal serial bus (USB), a display port (DP), a Thunderbolt, a video graphics array (VGA) port, an RGB port, a D-subminiature (D-SUB), or a digital visual interface (DVI). The input/output interface 110 may input or output at least one of an audio signal or a video signal. Depending on implementation examples, the input/output interface 110 may include a port inputting or outputting only audio signals and a port inputting or outputting only video signals as separate ports, or may be implemented as one port inputting or outputting both audio signals and video signals.

The electronic apparatus 100 and the source apparatus 200 may be connected through the input/output interface 110.

The display 120 may be implemented as displays in various forms such as a liquid crystal display (LCD), an organic light emitting diodes (OLED) display, a plasma display panel (PDP), etc. In the display 120, driving circuits that may be implemented in forms such as an amorphous silicon (a-si) thin film transistor (TFT), a low temperature poly silicon (LTPS) TFT, an organic TFT (OTFT), etc., and a backlight unit, etc. may also be included together. Meanwhile, the display 120 may be implemented as a touch screen combined with a touch sensor, a flexible display, a three-dimensional (3D) display, etc. Also, the display 120 according to an embodiment of the disclosure may include not only a display panel outputting images, but also a bezel housing the display panel. In particular, the bezel according to an embodiment of the disclosure may include a touch sensor (not shown) for detecting user interactions.

The processor 130 may perform overall controlling operations of the electronic apparatus 100. Specifically, the processor 130 performs a function of controlling the overall operations of the electronic apparatus 100.

The processor 130 may be implemented as a digital signal processor (DSP) processing digital signals, a microprocessor, and a time controller (TCON). However, the disclosure is not limited thereto, and the processor 130 may include one or more of a central processing unit (CPU), a micro controller unit (MCU), a micro processing unit (MPU), a controller, an application processor (AP), a graphics-processing unit (GPU) or a communication processor (CP), and an advanced reduced instruction set computer (RISC) machines (ARM) processor, or may be defined by the terms. Also, the processor 130 may be implemented as a system on chip (SoC) having a processing algorithm stored therein or large scale integration (LSI), or in the form of a field programmable gate array (FPGA). Further, the processor 130 may perform various functions by executing computer executable instructions stored in the memory.

If it is detected that the source apparatus 200 is connected through the input/output interface 110, the processor 130 may receive identification information of the source apparatus 200 from the source apparatus 200, and control the display 120 to display a user interface (UI) for changing a resolution based on the received identification information of the source apparatus 200. Then, if a user input for changing a resolution is received through the displayed UI, the processor 130 may identify whether the source apparatus 200 can transmit a content of the resolution corresponding to the user input based on the identification information of the source apparatus 200, and if it is identified that the source apparatus 200 can transmit a content of the resolution corresponding to the user input, the processor 130 may transmit a signal requesting the content of the resolution corresponding to the user input to the source apparatus 200 through the input/output interface 110.

Meanwhile, if a user input for changing the resolution of the received content is received, the processor 130 may identify whether the source apparatus 200 can transmit a content of the resolution corresponding to the user input based on the identification information of the source apparatus 200, and if it is identified that the source apparatus 200 cannot transmit a content of the resolution corresponding to the user input, the processor 130 may scale the content received from the source apparatus 200 to a resolution corresponding to the user input, and control the display 120 to display the scaled content.

If the electronic apparatus 100 is connected with the source apparatus 200, the processor 130 may request a content to the source apparatus 200 through the input/output interface 110. Then, the source apparatus 200 may transmit the content to the electronic apparatus 100 in response to the request of the electronic apparatus 100. The processor 130 may receive the content transmitted from the source apparatus 200 through the input/output interface 110. The requested content or the received content may be of a first resolution. The first resolution may be a basic resolution appropriate for the display 120 of the electronic apparatus 100. The processor 130 may control the display 120 to display the received content (the content of the first resolution).

The processor 130 may receive a user input for changing the resolution. Specifically, a user input for changing the resolution may be an input for changing the resolution to a second resolution different from the first resolution currently displayed. For example, it is assumed that the resolution currently displayed on the display 120 is the first resolution. The user input may be a user instruction by which the user changes the resolution from the first resolution to the second resolution. The first resolution and the second resolution may be different resolutions. Different resolutions may mean that the sizes are different or the ratios are different.

A user input according to an embodiment may be received through a remote control apparatus. Meanwhile, for a user input according to another embodiment, a user voice may be received through a microphone included in the electronic apparatus 100, and a user input may be acquired from the acquired user voice. For a user input according to still another embodiment, a user input may be received through a physical button or a touch display included in the electronic apparatus 100.

If a user input for changing the resolution from the first resolution to the second resolution is received, the processor 130 may identify whether the source apparatus 200 can support (or provide) the second resolution. When the electronic apparatus 100 is connected with the source apparatus 200, the processor 130 may receive information related to the source apparatus 200 through the input/output interface 110. The information related to the source apparatus 200 may mean the identification information of the source apparatus 200. The identification information of the source apparatus 200 may mean the model name or the model number, etc.

The processor 130 may identify whether the source apparatus 200 can support (or provide) the second resolution based on the acquired identification information of the source apparatus 200. The meaning of supporting (or providing) the second resolution may mean that a content of the second resolution can be transmitted.

According to an embodiment, the processor 130 may receive information on resolutions that the source apparatus 200 can support directly from the source apparatus 200. When it is identified that the source apparatus 200 is connected through the input/output interface 110, the processor 130 may request information related to the source apparatus 200 to the source apparatus 200. The information related to the source apparatus 200 may be information on resolutions that can be supported at the source apparatus 200. The source apparatus 200 may transmit the information on resolutions that can be supported by the source apparatus 200 to the electronic apparatus 100 in response to the request of the electronic apparatus 100. Then, the processor 130 may receive the information on resolutions that can be supported by the source apparatus 200.

According to another embodiment, the processor 130 may receive identification information from the source apparatus 200, and acquire resolution information corresponding to the acquired identification information of the source apparatus 200 based on a pre-stored table (e.g., 1005 in FIG. 10).

The processor 130 may compare the acquired information on resolutions that can be supported by the source apparatus 200 and the second resolution corresponding to a user input. Specifically, the processor 130 may determine a method of acquiring a content of the second resolution according to whether the information on resolutions that can be supported by the source apparatus 200 and the second resolution corresponding to the user input coincide.

Specifically, if the second resolution corresponding to the user input is included in the acquired information on resolutions that can be supported by the source apparatus 200, the processor 130 may identify that the source apparatus 200 can transmit a content of the second resolution (the resolution corresponding to the user input). Then, the processor 130 may request the content of the second resolution to the source apparatus 200. The source apparatus 200 may transmit the content of the second resolution to the electronic apparatus 100 in response to the request of the electronic apparatus 100. Then, the processor 130 may receive the content of the second resolution from the source apparatus 200 through the input/output interface 110.

If the second resolution corresponding to the user input is not included in the acquired information on resolutions that can be supported by the source apparatus 200, the processor 130 may identify that the source apparatus 200 cannot transmit a content of the second resolution. For providing the resolution that cannot be supported by the source apparatus 200, the processor 130 may directly perform a scaling function. Specifically, the processor 130 may change a content of the first resolution received from the source apparatus 200 to the second resolution corresponding to the user input. The processor 130 may scale the content of the first resolution to the content of the second resolution. For a scaling operation, the electronic apparatus 100 may include a scaler module, and it may be implemented as separate hardware from the processor 130.

The processor 130 may control the display 120 to display the content of the second resolution received from the source apparatus 200 or a content of the second resolution that it directly generated by using the scaler function.

Figure 5:
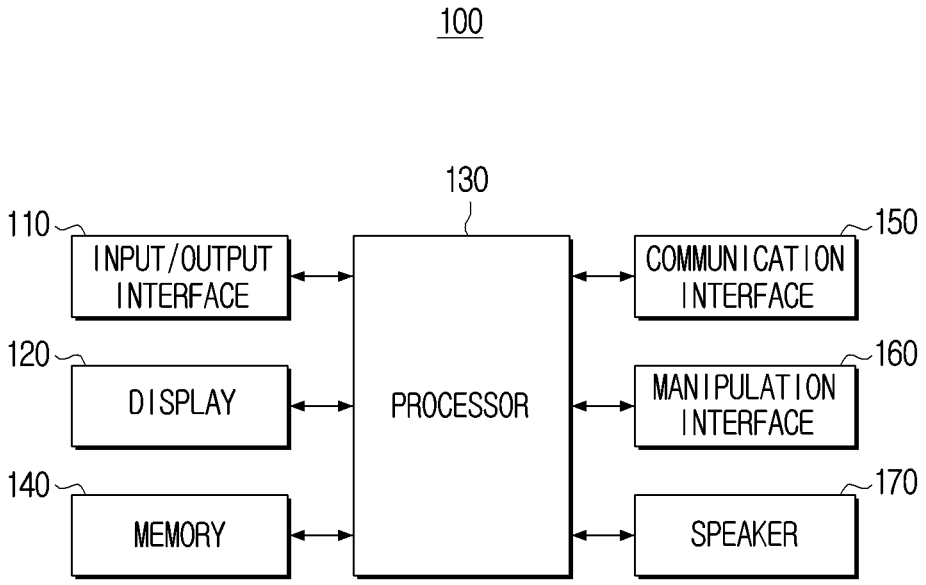
FIG. 5 is a block diagram for illustrating a detailed configuration of the electronic apparatus in FIG. 4 according to an embodiment of the disclosure.

Meanwhile, the electronic apparatus 100 may additionally store extended display identification data (EDID) information in the memory 140 of FIG. 5. Then, if it is identified that the source apparatus 200 can transmit a content of the resolution corresponding to the user input, the processor 130 may change the EDID information based on the resolution corresponding to the user input.

The EDID information may mean a standard for the electronic apparatus 100 including the display 120 to transmit information related to the display 120. The information related to the display 120 may include at least one of the identification information of the display 120, the size information, the information on resolutions that can be supported, or other characteristic information of the display 120. The identification information may mean the model name, the model number, etc. The size information may mean the number of pixels in horizontal and vertical directions installed on the display 120. The information on resolutions that can be supported may mean resolutions that can be supported according to the pixels of the display 120. The other characteristic information may include at least one of the color characteristic or timing information, or function information of the display 120. Also, in addition, the EDID information may include information regarding the name of the manufacturer, the year/month of manufacture of the product, the type of the product, the EDID version, the resolution and the color coordinate of the product, the types of the phosphors or the filters, the timing, the screen size, the luminance, the pixels, etc.

The processor 130 may store information on resolutions of contents displayed on the display 120 in the EDID information. If the resolution information currently included in the EDID information is the first resolution, the processor 130 may display a content of the first resolution on the display 120. If a user input selecting the second resolution is received, the processor 130 may change the resolution information included in the EDID information to the second resolution.

Meanwhile, if the EDID information is changed, the processor 130 may transmit a signal for notifying that the EDID information was changed to the source apparatus 200, and receive a content corresponding to the changed EDID information from the source apparatus 200, and control the display 120 to display the content received from the source apparatus 200.

If the EDID information is changed from the first resolution to the second resolution, the processor 130 may generate a signal for notifying that the EDID information was changed. Then, the processor 130 may transmit the generated signal to the source apparatus 200. The source apparatus 200 may receive the signal notifying that the EDID information was changed from the electronic apparatus 100, and transmit a content corresponding to the changed EDID information (a content of the second resolution) to the electronic apparatus 100 in response to the received signal. Then, the processor 130 may control the display 120 to display the received content of the second resolution.

The processor 130 may transmit a signal for notifying that the EDID information was changed to the source apparatus 200 according to various embodiments. According to an embodiment, if the EDID information is changed, the processor 130 may immediately transmit a signal for notifying that the EDID information was changed to the source apparatus 200. According to another embodiment, after the EDID information is changed, the processor 130 may transmit the EDID information to the source apparatus 200 per predetermined period. According to still another embodiment, if a signal requesting the EDID information is received from the source apparatus 200 after the EDID information is changed, the processor 130 may transmit the EDID information to the source apparatus 200.

Meanwhile, the signal for notifying that the EDID information was changed may be a signal changing a hot plug detect signal from a low state to a high state.

The hot plug detect signal may mean a signal that makes information related to the display 120 recognized at the source apparatus 200. For example, in case a hot plug detect signal is changed from a low state to a high state, the source apparatus 200 may determine that the EDID information was changed.

The hot plug detect signal may be transmitted to the source apparatus 200 through a hot plug detect pin constituting a high definition multimedia interface (HDMI).

The hot plug detect signal may be a signal standard for determining whether an HDMI cable was connected or released according to an HDMI standard. If the electronic apparatus 100 is connected with the source apparatus 200 through the HDMI cable, a voltage detected through a specific pin of the HDMI port, i.e., the hot plug detect signal may be transitioned from 0V to a predetermined voltage, e.g., 5V. If the hot plug detect signal is transitioned to the predetermined voltage, the source apparatus 200 may recognize that the HDMI cable is connected, and read the EDID information of the sync apparatus (the electronic apparatus 100). Accordingly, if the processor 130 arbitrarily transitions the hot plug detect signal from a low state to a high state, the same effect as an operation that the HDMI cable is connected after being released may be exerted.

For example, No. 18 and No. 19 pins among 19 pins constituting the HDMI port may perform functions related to the hot plug detect signal. For example, the No. 18 and No. 19 pins of the HDMI port provided in the electronic apparatus 100 may be connected through a switch or implemented as components having the same effect. A voltage of +5V may be applied through the No. 18 pin of the HDMI port provided in the source apparatus 200, and if it is a state wherein both HDMI ports are connected through the HDMI cable, the same voltage of +5V may be detected in the No. 19 pin of the HDMI port provided in the source apparatus 200. The source apparatus 200 may recognize that the sync apparatus (the electronic apparatus 100) is connected through the HDMI cable, and read the EDID information of the electronic apparatus 100.

If the EDID information of the memory 140 is updated, the processor 130 may change the switch connecting the No. 18 pin and No. 19 pin of the HDMI port provided in the electronic apparatus 100 to an OFF state, and then change the state to an ON state again, and transmit the hot plug detect signal of +5V to the source apparatus 200. In this case, the source apparatus 200 may detect the hot plug detect signal and read the updated EDID information in the memory 140. That is, by determining that a new sync apparatus is connected by detecting a voltage signal, the source apparatus 200 may read the EDID information again and update the information. Then, the source apparatus 200 may set the output based on the updated EDID information. Then, according to such a setting of the output, the source apparatus 200 may provide the content of the second resolution requested from the electronic apparatus 100.

Meanwhile, according to another embodiment, the processor 130 may generate a hot plug detect signal, and transmit the generated signal to the source apparatus 200 through a specific pin of the HDMI port.

Meanwhile, the electronic apparatus 100 may further include a memory 140 storing a table wherein identification information of a plurality of source apparatuses 200 and resolution information corresponding to the respective identification information are mapped, and the processor 130 may identify resolution information corresponding to the identification information of the source apparatus 200 based on the table stored in the memory, and identify whether the source apparatus 200 can transmit a content of the resolution corresponding to the user input based on the identified resolution information.

The processor 130 may store a table (or a mapping table) related to the source apparatus 200 in the memory 140 of FIG. 5. The table may include at least one of the identification information of the source apparatus 200, the information on resolutions that can be supported by the source apparatus 200, or the information indicating whether the source apparatus 200 can perform a scaling function.

The stored table may include the identification information of the plurality of respective source apparatuses and the information on resolutions that can be supported in the plurality of respective source apparatuses. Accordingly, if only the identification information of a specific source apparatus is identified based on the table, resolutions that can be supported in the specific source apparatus can be identified. This is because identification information and resolution information are mapped and stored in the table.

Accordingly, the processor 130 may use the table and the identification information of the source apparatus 200 for determining whether the source apparatus 200 can provide a content of the second resolution corresponding to the user input. If the resolutions corresponding to the identification information of the source apparatus 200 in the table include the second resolution, the processor 130 may determine that the source apparatus 200 can transmit a content of the second resolution.

Specific operations related to the above will be described later in FIGS. 8 and 10.

Meanwhile, the input/output interface 110 is a high definition multimedia interface (HDMI), and if the source apparatus 200 is connected through the input/output interface 110, the processor 130 may acquire the identification information of the source apparatus 200 from the source apparatus 200.

The processor 130 may be connected with the source apparatus 200 through the HDMI port. That is, the electronic apparatus 100 and the source apparatus 200 may be in a state of being connected via wire, and they may transmit and receive information with each other via wire. Then, if the electronic apparatus 100 and the source apparatus 200 are connected through the HDMI port, the source apparatus 200 may transmit the identification information of the source apparatus 200 to the electronic apparatus 100. Then, the processor 130 may receive the identification information transmitted by the source apparatus 200 through the HDMI port.

Meanwhile, the processor 130 may identify whether the source apparatus 200 can scale a content based on the identification information of the source apparatus 200, and if it is identified that the source apparatus 200 can scale a content, the processor 130 may transmit a signal requesting a content of the resolution corresponding to the user input to the source apparatus 200. Meanwhile, if it is identified that the source apparatus 200 cannot scale a content, the processor 130 may scale the content received from the source apparatus 200 to the resolution corresponding to the user input.

The processor 130 may determine whether the source apparatus 200 can perform the scaling function by using the table stored in the memory 140. Specifically, the table may include information indicating whether the plurality of respective source apparatuses can perform the scaling function. Accordingly, the processor 130 may determine whether the source apparatus 200 can perform the scaling function based on the acquired identification information of the source apparatus 200.

If the source apparatus 200 has the scaling function, the processor 130 may request a content of the second resolution corresponding to the user input to the source apparatus 200. Meanwhile, if the source apparatus 200 does not have the scaling function, the processor 130 may directly scale a content of the first resolution to a content of the second resolution.

Meanwhile, the UI may be a UI for selecting one resolution among a plurality of resolutions. The processor 130 may control the display 120 to display a UI for selecting one resolution among a plurality of resolutions, and if a user input selecting one resolution is received through the displayed UI, the processor 130 may identify whether the source apparatus 200 can transmit a content of the resolution corresponding to the user input based on the identification information of the source apparatus 200.

Detailed explanation related to the UI for selecting one resolution among a plurality of resolutions will be made later in FIGS. 13 to 15.

Meanwhile, the processor 130 may identify a plurality of resolutions that can be displayed on the display 120 based on the resolution information of the display 120, and control the display 120 to display a UI for selecting one resolution among the plurality of identified resolutions.

The resolution information of the display 120 may mean resolutions that can be provided to a user according to the hardware or software characteristics of the display 120. The resolution information of the display 120 may have been stored in the memory 140. Accordingly, the processor 130 may identify a plurality of resolutions that can be displayed on the display 120 based on the resolution information of the display 120 stored in the memory 140.

Meanwhile, if it is identified that the source apparatus 200 cannot transmit a content of the resolution corresponding to the user input, the processor 130 may control the display 120 to display a UI including at least one of information notifying that the source apparatus 200 cannot transmit a content of the resolution corresponding to the user input, the identification information of the source apparatus 200, the resolution information of the source apparatus 200, or information for guiding such that the content received from the source apparatus 200 is scaled to the resolution corresponding to the user input at the electronic apparatus.

Detailed explanation in this regard will be made later in FIG. 16.

Meanwhile, the processor 130 may display a thumbnail image corresponding to a resolution. The thumbnail image may mean an image indicating in which format a content will be displayed in case the content is changed to a specific resolution, so that a user can easily understand the resolution. For example, it is assumed that the electronic apparatus 100 is a 65 inch TV, and that the resolution is wide ultra high definition (WUHD) (5120×2160) in a ratio of 21:9. The thumbnail image may include a display object indicating a 65 inch TV and a content display object in a ratio of 21:9. Accordingly, the user may intuitively understand the resolution of WUHD (5120×2160) in a ratio of 21:9 through the thumbnail image.

Also, a thumbnail image corresponding to a resolution to which a user wishes to change may be displayed. For example, in displaying the UI for selecting one resolution among the plurality of resolutions, thumbnail images corresponding to the plurality of respective resolutions may be included in the displayed screen.

Specific operations related to thumbnail images will be described later in FIGS. 17 to 19.

Meanwhile, the disclosure discloses a feature of determining whether a content of a resolution corresponding to a user input can be provided at the source apparatus 200 in response to a user input for changing the resolution of a received content, without performing scaling at the electronic apparatus 100 directly. Accordingly, the electronic apparatus 100 may preferentially determine whether a content of a resolution desired by a user can be provided at the source apparatus 200. As a content of a resolution desired by a user is provided preferentially through the source apparatus 200, a process of displaying a content can be managed effectively.

Meanwhile, in the above, only simple components constituting the electronic apparatus 100 were illustrated and described, but various components may additionally be included in actual implementation. Explanation in this regard will be made below with reference to FIG. 5.

FIG. 5 is a block diagram for illustrating a detailed configuration of the electronic apparatus in FIG. 4 according to an embodiment of the disclosure.

Referring to FIG. 5, the electronic apparatus 100 may consist of an input/output interface 110, a display 120, a processor 130, a memory 140, a communication interface 150, a manipulation interface 160, and a speaker 170.

Meanwhile, among the operations of the input/output interface 110, the display 120, and the processor 130, regarding the same operations as described above, overlapping explanation will be omitted.

The memory 140 may be implemented as an internal memory such as a read-only memory (ROM) (e.g., an electrically erasable programmable read-only memory (EEPROM)), a random access memory (RAM), etc. included in the processor 130, or a memory separate from the processor 130. In this case, the memory 140 may be implemented in a form of a memory embedded in the electronic apparatus 100, or in a form of a memory that can be attached to or detached from the electronic apparatus 100 according to the use of stored data. For example, in the case of data for driving of the electronic apparatus 100, the data may be stored in a memory embedded in the electronic apparatus 100, and in the case of data for an extended function of the electronic apparatus 100, the data may be stored in a memory that can be attached to or detached from the electronic apparatus 100.

Meanwhile, in the case of a memory embedded in the electronic apparatus 100, the memory may be implemented as at least one of a volatile memory (e.g.: a dynamic RAM (DRAM), a static RAM (SRAM), or a synchronous dynamic RAM (SDRAM), etc.) or a non-volatile memory (e.g.: an one time programmable ROM (OTPROM), a programmable ROM (PROM), an erasable and programmable ROM (EPROM), an electrically erasable and programmable ROM (EEPROM), a mask ROM, a flash ROM, a flash memory (e.g.: not and (NAND) flash or not or (NOR) flash, etc.), a hard drive, or a solid state drive (SSD)). Also, in the case of a memory that can be attached to or detached from the electronic apparatus 100, the memory may be implemented in forms such as a memory card (e.g., compact flash (CF), secure digital (SD), micro secure digital (Micro-SD), mini secure digital (Mini-SD), extreme digital (xD), a multimedia card (MMC), etc.), an external memory that can be connected to a USB port (e.g., a USB memory), etc.

The communication interface 150 is a component performing communication with various types of external apparatuses according to various types of communication methods. The communication interface 150 may include a Wi-Fi module, a Bluetooth module, an infrared communication module, a wireless communication module, etc. Each communication module may be implemented in a form of at least one hardware chip.

A Wi-Fi module and a Bluetooth module may perform communication by using a Wi-Fi method and a Bluetooth method, respectively. In the case of using a Wi-Fi module or a Bluetooth module, various types of connection information such as a service set identifier (SSID) and a session key is transmitted and received first, and connection of communication is performed by using the information, and various types of information can be transmitted and received thereafter.

An infrared communication module performs communication according to an infrared Data Association (IrDA) technology of transmitting data to a near field wirelessly by using infrared rays between visible rays and millimeter waves.

A wireless communication module may include at least one communication chip that performs communication according to various wireless communication protocols such as Zigbee, 3rd Generation (3G), 3rd Generation Partnership Project (3GPP), Long Term Evolution (LTE), LTE Advanced (LTE-A), 4th Generation (4G), 5th Generation (5G), etc. other than the aforementioned communication methods.

Other than the above, the communication interface 150 may include at least one of a local area network (LAN) module, an Ethernet module, or a wired communication module that performs communication by using a pair cable, a coaxial cable, an optical fiber cable, or an ultra wide-band (UWB) module, etc.

The manipulation interface 160 (e.g., user interface) may be implemented as a device such as buttons, a touch pad, a mouse, and a keyboard, or implemented as a touch screen that can perform the aforementioned display function and a manipulation input function together. The buttons may be various types of buttons such as mechanical buttons, a touch pad, a wheel, etc. formed in any areas such as the front surface part, the side surface part, the rear surface part, etc. of the exterior of the main body of the electronic apparatus 100.

The electronic apparatus 100 may include a speaker 170. The speaker 170 may be a component that outputs various kinds of notification sounds or voice messages as well as various types of audio data processed at the input/output interface.

The electronic apparatus 100 may further include a microphone (not shown). The microphone is a component for receiving input of user voices or other sounds and converting them into audio data. The microphone (not shown) may receive a voice of a user in an activated state. For example, the microphone (not shown) may be formed as an integrated type on the upper side or the front surface direction, the side surface direction, etc. of the electronic apparatus 100. The microphone (not shown) may include various components such as a microphone collecting a user voice in an analogue form, an amp circuit amplifying the collected user voice, an analog-to-digital (A/D) conversion circuit that samples the amplified user voice and converts the user voice into a digital signal, a filter circuit that removes noise components from the converted digital signal, etc.

Figure 6:
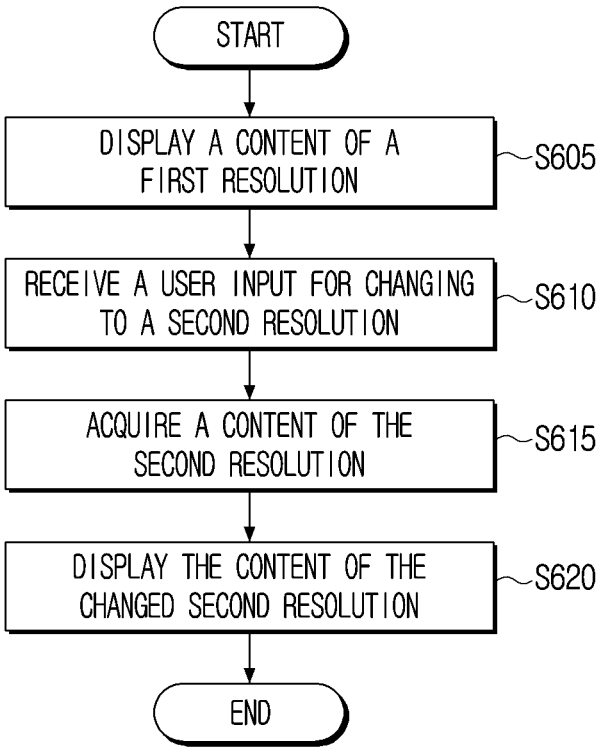
FIG. 6 is a flowchart for illustrating an operation of changing a resolution of a displayed content according to an embodiment of the disclosure.

FIG. 6 is a flowchart for illustrating an operation of changing a resolution of a displayed content according to an embodiment of the disclosure.

Referring to FIG. 6, the electronic apparatus 100 may display a content of the first resolution in operation S605. Even if the electronic apparatus 100 does not necessarily display a content of the first resolution, it may be a state wherein the resolution currently displaying a content is the first resolution.

Then, the electronic apparatus 100 may receive a user input for changing the first resolution to the second resolution in operation S610. The user input may be an input for changing the resolution of the display of the electronic apparatus 100 to the second resolution, or an input for changing the resolution of a content displayed on the electronic apparatus 100 to the second resolution.

Then, the electronic apparatus 100 may acquire the content of the second resolution corresponding to the user input in operation S615. According to an embodiment, the electronic apparatus 100 may acquire the content of the second resolution from the source apparatus 200. According to another embodiment, the electronic apparatus 100 may generate the content of the second resolution by itself.

Then, the electronic apparatus 100 may display the acquired content of the second resolution in operation S620. Meanwhile, the operation S605 of displaying a content of the first resolution may be omitted depending on implementation examples.

Figure 7:
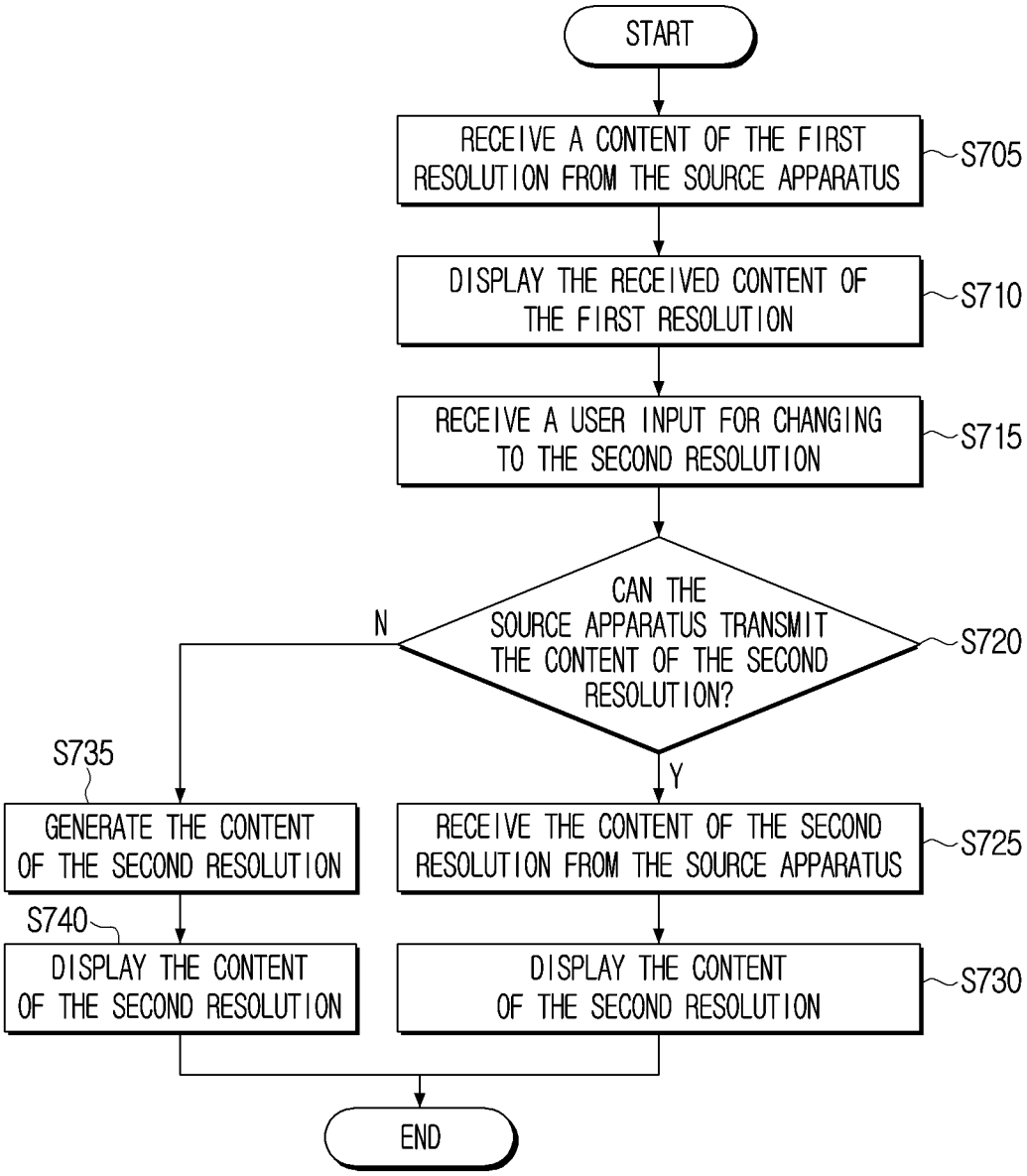
FIG. 7 is a flowchart for illustrating an operation of displaying a content of a resolution corresponding to a user input according to an embodiment of the disclosure.

FIG. 7 is a flowchart for illustrating an operation of displaying a content of a resolution corresponding to a user input according to an embodiment of the disclosure.

Referring to FIG. 7, the electronic apparatus 100 may receive a content of the first resolution from the source apparatus 200 in operation S705. Then, the electronic apparatus 100 may display the received content of the first resolution in operation S710.

Meanwhile, the electronic apparatus 100 may receive a user input for changing the resolution to the second resolution in operation S715. The electronic apparatus 100 may identify whether the source apparatus 200 connected with the electronic apparatus 100 can transmit a content of the second resolution in operation S720.

If it is identified that the source apparatus 200 can transmit a content of the second resolution in operation S720-Y, the electronic apparatus 100 may receive the content of the second resolution from the source apparatus 200 in operation S725. Then, the electronic apparatus 100 may display the content of the second resolution received from the source apparatus 200 in operation S730.

Meanwhile, if it is identified that the source apparatus 200 cannot transmit a content of the second resolution in operation S720-N, the electronic apparatus 100 may generate the content of the second resolution in operation S735. Then, the electronic apparatus 100 may display the generated content of the second resolution in operation S740.

Meanwhile, the operations S705 and S710 of receiving and displaying a content of the first resolution may be omitted depending on implementation examples.

Figure 8:
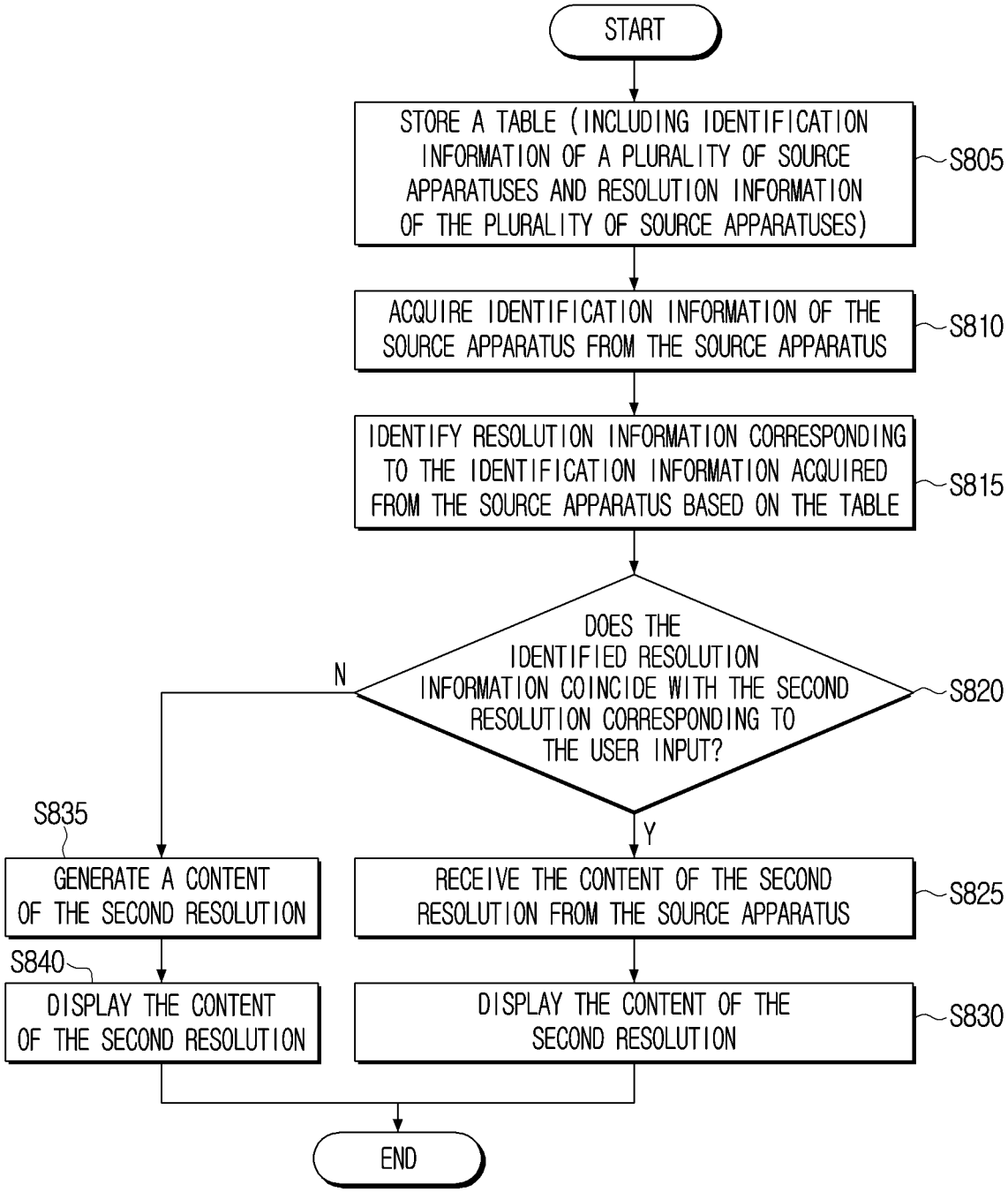
FIG. 8 is a flowchart for illustrating whether a source apparatus can provide a content of a resolution corresponding to a user input according to an embodiment of the disclosure.

FIG. 8 is a flowchart for illustrating whether a source apparatus can provide a content of a resolution corresponding to a user input according to an embodiment of the disclosure.

Referring to FIG. 8, the electronic apparatus 100 may store a table related to the source apparatus 200 in operation S805. The table related to the source apparatus 200 may include identification information of a plurality of source apparatuses and resolution information of the plurality of source apparatuses. The identification information and the resolution information may be mapped with each other and stored in the table. Then, the electronic apparatus 100 may acquire the identification information of the source apparatus 200 from the source apparatus 200 in operation S810. Specifically, when the source apparatus 200 is connected with the electronic apparatus 100, the source apparatus 200 may transmit the identification information of the source apparatus 200 to the electronic apparatus 100.

Then, the electronic apparatus 100 may identify resolution information corresponding to the identification information acquired from the source apparatus 200 based on the stored table in operation S815. Specifically, the electronic apparatus 100 may determine whether the identification information of the source apparatus 200 is stored in the table. The electronic apparatus 100 may acquire the identification information of the source apparatus 200 among the plurality of identification information in the stored table. Then, if it is assumed that the identification information of the source apparatus 200 is stored in the table, the electronic apparatus 100 may acquire resolution information corresponding to the identification information of the source apparatus 200.

The electronic apparatus 100 may identify whether the identified resolution information coincides with the second resolution corresponding to the user input in operation S820. The resolution information identified by the electronic apparatus 100 based on the table may be the resolution that can be provided by the source apparatus 200. Accordingly, if the identified resolution information and the second resolution corresponding to the user input do not coincide, the electronic apparatus 100 may determine that the source apparatus 200 cannot provide the content of the second resolution.

In case the identified resolution information coincides with the second resolution corresponding to the user input in operation S820-Y, the electronic apparatus 100 may receive the content of the second resolution from the source apparatus 200 in operation S825. Then, the electronic apparatus 100 may display the received content of the second resolution in operation S830.

In case the identified resolution information does not coincide with the second resolution corresponding to the user input in operation S820-N, the electronic apparatus 100 may directly generate the content of the second resolution in operation S835. Then, the electronic apparatus 100 may display the generated content of the second resolution in operation S840.

Figure 9:
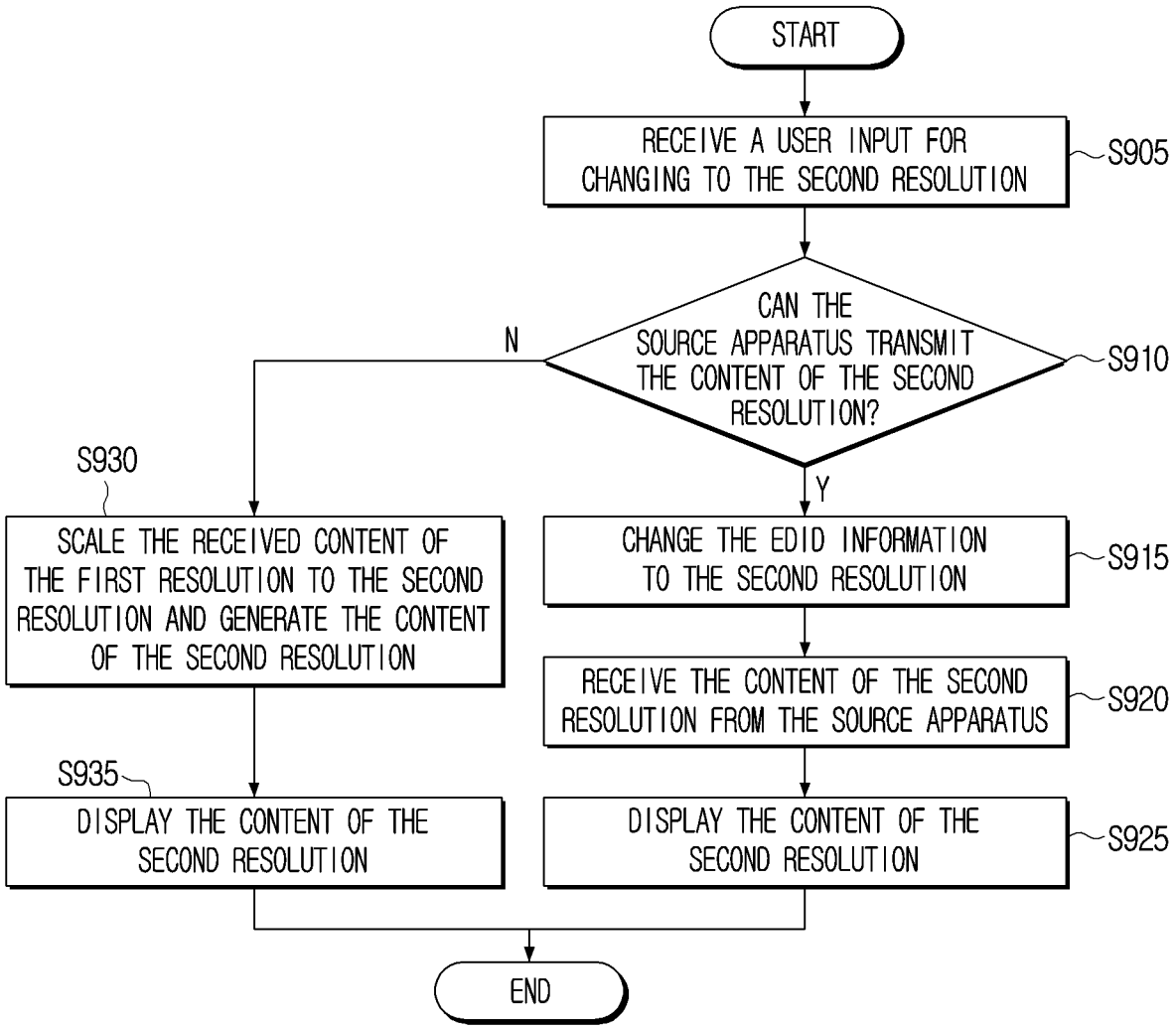
FIG. 9 is a diagram for illustrating an operation of acquiring a content of a resolution corresponding to a user input according to an embodiment of the disclosure.

FIG. 9 is a diagram for illustrating an operation of acquiring a content of a resolution corresponding to a user input according to an embodiment of the disclosure.

Referring to FIG. 9, the electronic apparatus 100 may receive a user input for changing the first resolution to the second resolution in operation S905. The electronic apparatus 100 may identify whether the source apparatus 200 can transmit (or provide) the content of the second resolution in operation S910.

If it is identified that the source apparatus 200 can transmit a content of the second resolution in operation S910-Y, the electronic apparatus 100 may change the EDID information to the second resolution in operation S915. Specifically, the electronic apparatus 100 may change the EDID information from the first resolution to the second resolution. Then, after the EDID information is changed to the second resolution, the electronic apparatus 100 may receive the content of the second resolution from the source apparatus 200 in operation S920. Then, the electronic apparatus 100 may display the content of the second resolution received from the source apparatus 200 in operation S925.

If it is identified that the source apparatus 200 cannot transmit a content of the second resolution in operation S910-N, the electronic apparatus 100 may scale the received content of the first resolution to the content of the second resolution, and generate the content of the second resolution in operation S930. Then, the electronic apparatus 100 may display the generated content of the second resolution in operation S935.

FIG. 10 is a diagram for illustrating a table including information related to the source apparatus according to an embodiment of the disclosure.

Referring to FIG. 10, the table 1005 may include information related to the source apparatus 200. The information related to the source apparatus 200 may mean information used in determining the resolutions that can be provided by the source apparatus 200. Specifically, the table 1005 may include at least one of identification information of at least one source apparatus, information on resolutions that can be supported (or provided) by the at least one source apparatus, or information indicating whether a scaling function is performed.

The identification information of the source apparatus may mean the model name, the model number, the serial number, etc. The information on resolutions that can be supported may mean resolutions that are basically provided at the source apparatus. For example, the source apparatus in A-01 may support a quad high definition (QHD) resolution, and the apparatus may mean an apparatus providing a content of a QHD resolution.

The information indicating whether the scaling function is performed may mean information by which it can be identified whether the source apparatus can support resolutions other than the basic resolutions. For example, the source apparatus in A-01 can support the QHD resolution, but the apparatus cannot perform the scaling function, and thus it cannot support resolutions other than the QHD. However, the source apparatus in A-02 basically supports the QHD resolution, and it may support other resolutions through the scaling function.

Also, in the case of the source apparatus in B-01, there may be a plurality of resolutions that can be supported. Accordingly, the source apparatus in B-01 may store (or receive) contents having a plurality of resolutions, and provide a content that fits the resolution requested by the electronic apparatus 100.

Meanwhile, a source apparatus that can perform the scaling function may provide resolutions other than the resolutions that can be supported. For example, the source apparatus in A-02 basically supports the QHD, but it may support a full high definition (FHD) resolution or an ultra high definition (UHD) resolution by using the scaling function.

According to an embodiment, as the scaling function, only downscaling may be possible. Accordingly, a source apparatus can change a resolution only to a resolution lower than the resolutions that can be basically supported.

According to another embodiment, as the scaling function, both of downscaling and upscaling may be possible. Accordingly, a source apparatus can change a resolution to a resolution higher or lower than the resolutions that can be basically supported.

Figure 11:
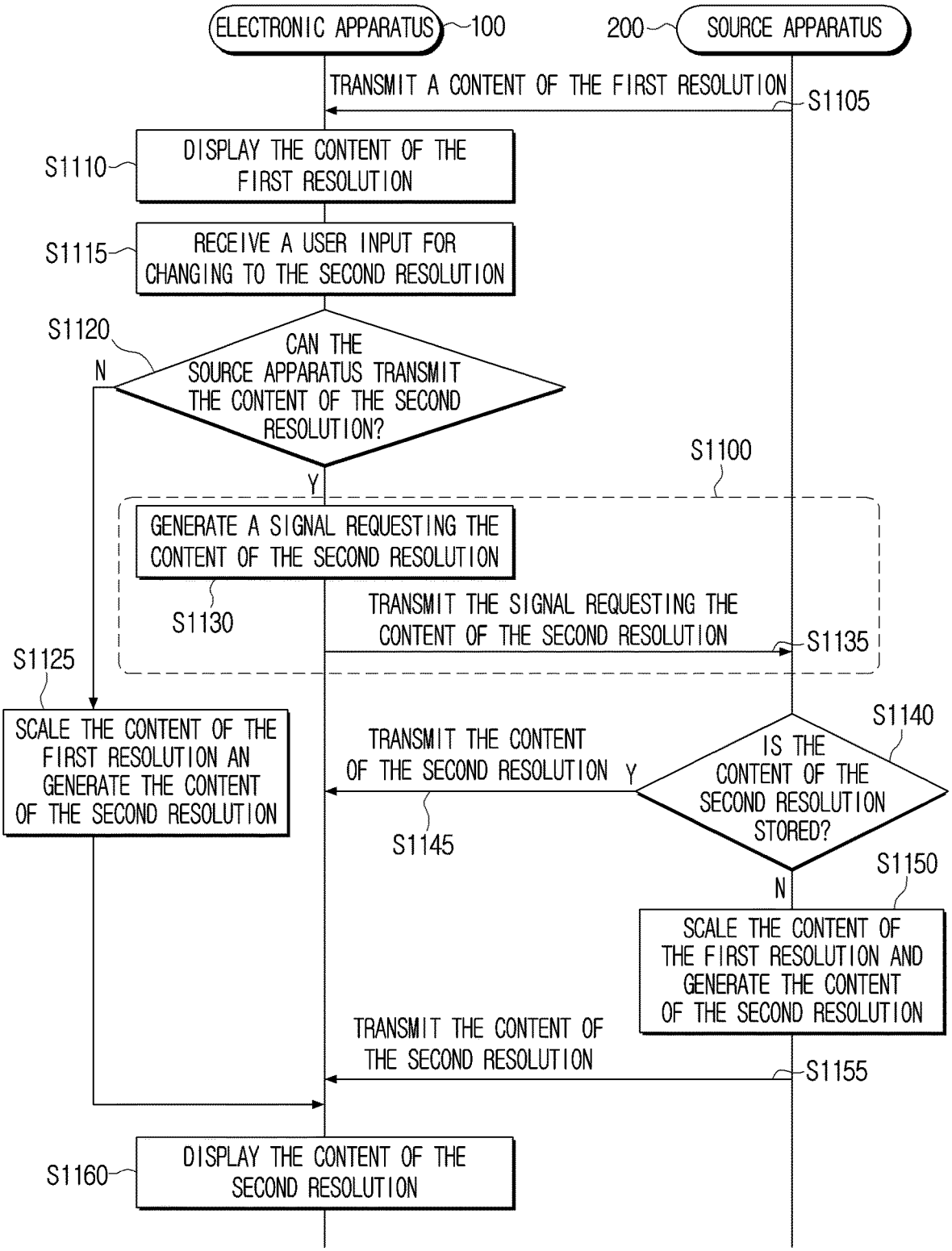
FIG. 11 is a diagram for illustrating an operation performed for receiving a content of a second resolution at the source apparatus according to an embodiment of the disclosure.

FIG. 11 is a diagram for illustrating an operation performed for receiving a content of a second resolution at the source apparatus according to an embodiment of the disclosure.

Referring to FIG. 11, the source apparatus 200 may transmit a content of the first resolution to the electronic apparatus 100 in operation S1105. Then, the electronic apparatus 100 may display the content of the first resolution in operation S1110. Then, the electronic apparatus 100 may receive a user input for changing the content to a content of the second resolution in operation S1105.

The electronic apparatus 100 may identify whether the source apparatus 200 can transmit a content of the second resolution in operation S1120. If it is identified that the source apparatus 200 cannot transmit a content of the second resolution in operation S1120-N, the electronic apparatus 100 may directly scale the content of the first resolution, and generate the content of the second resolution in operation S1125. Then, the electronic apparatus 100 may display the content of the second resolution in operation S1160.

Meanwhile, if it is identified that the source apparatus 200 can transmit a content of the second resolution in operation S1120-Y, the electronic apparatus 100 may perform an operation S1100 for receiving the content of the second resolution. The operation for receiving the content of the second resolution according to an embodiment may include an operation S1130 of the electronic apparatus 100 of generating a signal requesting the content of the second resolution, and an operation S1135 of the electronic apparatus 100 of transmitting the generated signal requesting the content of the second resolution to the source apparatus 200.

The signal requesting the content of the second resolution may mean a hot plug detect signal. The electronic apparatus 100 may change the hot plug detect signal from a low state to a high state. Also, the electronic apparatus 100 may make the changed hot plug detect signal transmitted to the source apparatus 200 or make the changed hot plug detect signal read by the source apparatus 200.

Also, when the signal requesting the content of the second resolution is received, the source apparatus 200 may identify whether the content of the second resolution is stored in the memory of the source apparatus 200 in operation S1140. If the content of the second resolution is stored in the memory of the source apparatus 200 in operation S1140-Y, the source apparatus 200 may transmit the stored content of the second resolution to the electronic apparatus 100 in operation S1145.

Further, if the content of the second resolution is not stored in the memory of the source apparatus 200 in operation S1140-N, the source apparatus 200 may scale the content of the first resolution and generate the content of the second resolution in operation S1150. Then, the source apparatus 200 may transmit the generated content of the second resolution to the electronic apparatus 100 in operation S1155. Then, the electronic apparatus 100 may receive the content of the second resolution from the source apparatus 200. Then, the electronic apparatus 100 may display the content of the second resolution in operation S1160.

Figure 12:
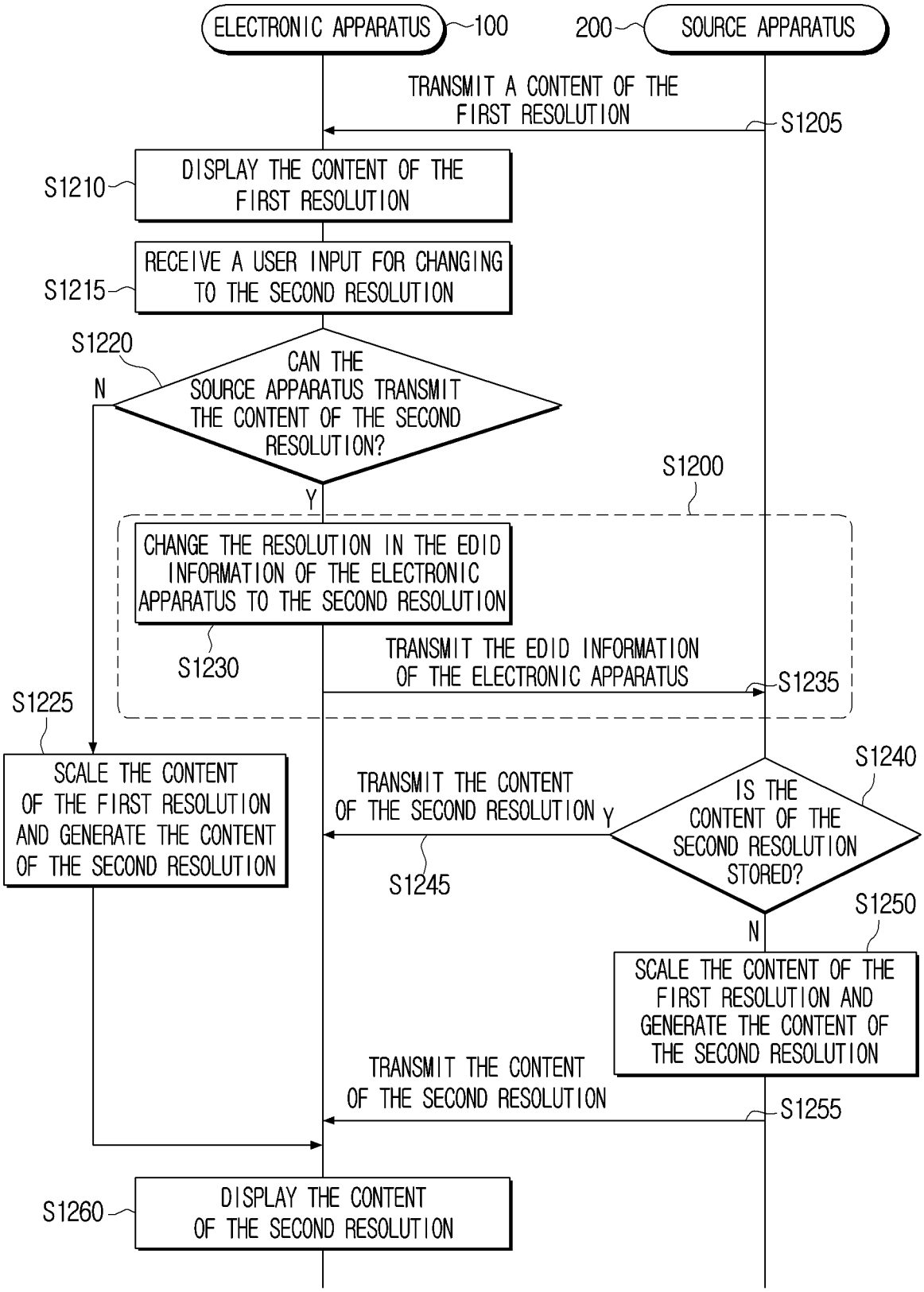
FIG. 12 is a diagram for illustrating an operation performed for receiving a content of the second resolution at the source apparatus according to an embodiment of the disclosure.

FIG. 12 is a diagram for illustrating an operation performed for receiving a content of the second resolution at the source apparatus according to an embodiment of the disclosure.

Referring to FIG. 12, the operations S1205, S1210, S1215, S1220, S1225, S1240, S1245, S1250, S1255, and S1260 may correspond to the operations S1105, S1110, S1115, S1120, S1125, S1140, S1145, S1150, S1155, and S1160 in FIG. 11. Accordingly, overlapping explanation will be omitted.

The operation S1100 for receiving a content of the second resolution in FIG. 11 may be replaced by the operation S1200 for receiving a content of the second resolution in FIG. 12. Also, the operation S1200 for receiving the content of the second resolution may include the operation S1230 of changing the part wherein the resolution is stored in the EDID information of the electronic apparatus 100 to the second resolution, and the operation S1235 of transmitting the changed EDID information of the electronic apparatus 100 to the source apparatus 200. Meanwhile, it was described that the electronic apparatus 100 transmits the changed EDID according to the operation S1235, but depending on implementation examples, it may be described that the source apparatus 200 reads the changed EDID of the electronic apparatus 100.

After the changed EDID information of the electronic apparatus 100 is received, the source apparatus 200 may recognize the second resolution included in the changed EDID information. Then, the source apparatus 200 may identify whether the content of the second resolution is stored in the memory of the source apparatus 200 in operation S1240.

Figure 13:
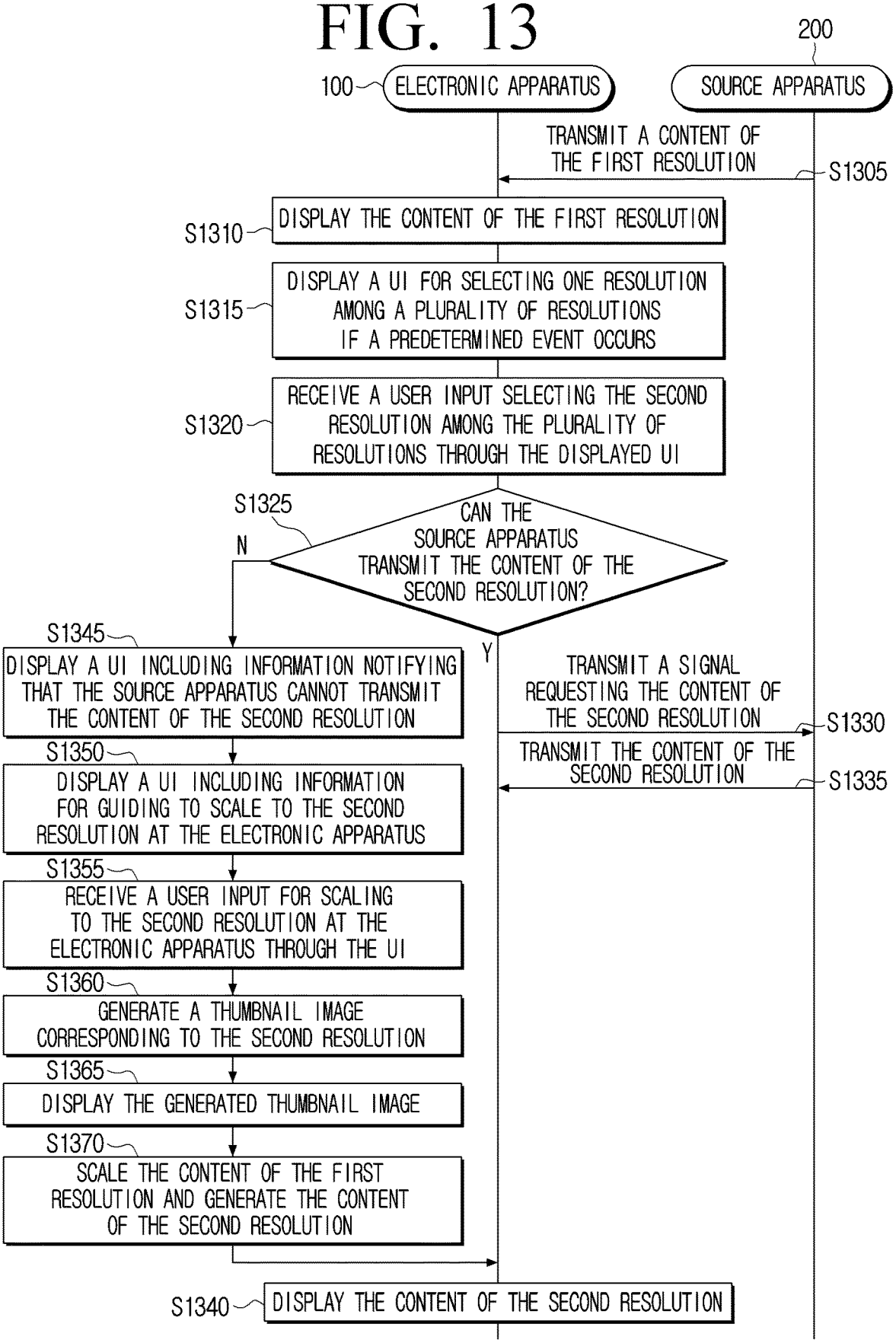
FIG. 13 is a flowchart for illustrating various UIs or images displayed in a process of displaying a content of the second resolution according to an embodiment of the disclosure.

FIG. 13 is a flowchart for illustrating various UIs or images displayed in a process of displaying a content of the second resolution according to an embodiment of the disclosure.

Referring to FIG. 13, the source apparatus 200 may transmit a content of the first resolution to the electronic apparatus 100 in operation S1305. Then, the electronic apparatus 100 may display the content of the first resolution received from the source apparatus 200 in operation S1310.

The electronic apparatus 100 may display a UI for selecting one resolution among a plurality of resolutions when a predetermined event occurs (e.g., 1401 to 1405 in FIGS. 14, 1501 to 1505 in FIG. 15) in operation S1315. The predetermined event may mean an event wherein a user selects a setting menu for changing the resolution or an event wherein the source apparatus 200 is connected. Meanwhile, depending on implementation examples, the predetermined event may mean an event wherein a new source apparatus 200 that had never been connected before is connected.

The electronic apparatus 100 may receive a user input selecting the second resolution among the plurality of resolutions through the displayed UI in operation S1320. Then, the electronic apparatus 100 may identify whether the source apparatus 200 can transmit a content of the second resolution corresponding to the user input in operation S1325.

If it is identified that the source apparatus 200 can transmit a content of the second resolution in operation S1325-Y, the electronic apparatus 100 may transmit a signal requesting the content of the second resolution to the electronic apparatus 100 in operation S1330. Then, the source apparatus 200 may transmit the content of the second resolution to the electronic apparatus 100 according to the request of the electronic apparatus 100 in operation S1335. Then, the electronic apparatus 100 may display the content of the second resolution in operation S1340.

Meanwhile, if it is identified that the source apparatus 200 cannot transmit a content of the second resolution in operation S1325-N, the electronic apparatus 100 may display a UI including information that the content of the second resolution cannot be transmitted from the source apparatus 200 (e.g., 1601 in FIG. 16) in operation S1345.

Also, the electronic apparatus 100 may display a UI including information for guiding the electronic apparatus 100 to scale to the second resolution (e.g., 1604 in FIG. 16) in operation S1350.

In addition, the electronic apparatus 100 may receive a user input for the electronic apparatus 100 to scale to the second resolution through a UI (the UI displayed in the operation S1350) in operation S1355.

Further, when the user input in the operation S1355 is received, the electronic apparatus 100 may generate a thumbnail image corresponding to the second resolution (e.g., 1702 in FIG. 17) in operation S1360. Then, the electronic apparatus 100 may display the generated thumbnail image in operation S1365.

Also, the electronic apparatus 100 may scale the content of the first resolution and generate the content of the second resolution in operation S1370. It is described that the operation S1360 and the operation S1365 are performed prior to the operation S1370, but depending on implementation examples, the operation S1360 and the operation S1365 may be performed at the same time as the operation S1370, or performed after the operation S1370.

Then, after the content of the second resolution is generated, the electronic apparatus 100 may display the content of the second resolution in operation S1340.

Figure 14:
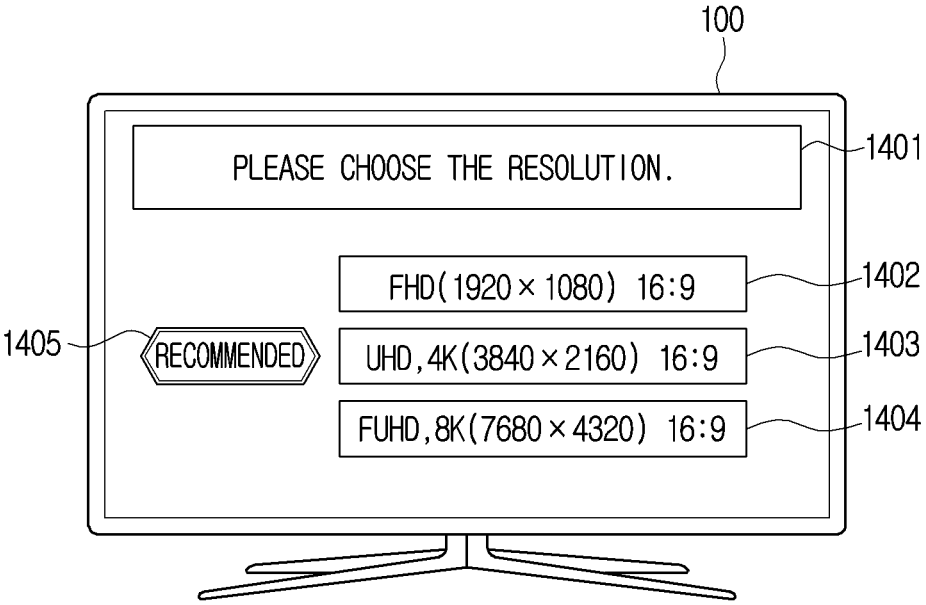
FIG. 14 is a diagram for illustrating a UI for a user to select a resolution according to an embodiment of the disclosure.

FIG. 14 is a diagram for illustrating a UI for a user to select a resolution according to an embodiment of the disclosure.

Referring to FIG. 14, the electronic apparatus 100 may display information 1401 notifying that the screen currently displayed is a screen for selecting one resolution among the plurality of resolutions. Then, the electronic apparatus 100 may display information on the plurality of resolutions in UIs 1402 to 1404. The electronic apparatus 100 may display at least one of the acronym information, the size information, or the ratio information of the resolutions.

For example, the UI 1402 may include the acronym information (FHD), the size information (1920×1080), and the ratio information (16:9). Also, the UI 1403 may include the acronym information (UHD), the size information (3840×2160), and the ratio information (16:9). Further, the UI 1404 may include the acronym information (full ultra high definition (FUHD)), the size information (7680×4320), and the ratio information (16:9).

The electronic apparatus 100 may display a UI 1405 expressing the recommended resolution. The electronic apparatus 100 may store the recommended resolution corresponding to the size of the display. Then, the electronic apparatus 100 may display the recommended resolution notifying UI 1405 to notify the UI 1403 corresponding to the recommended resolution to the user. As the recommended resolution is notified to the user, the user can easily figure out the optimal resolution.

Figure 15:
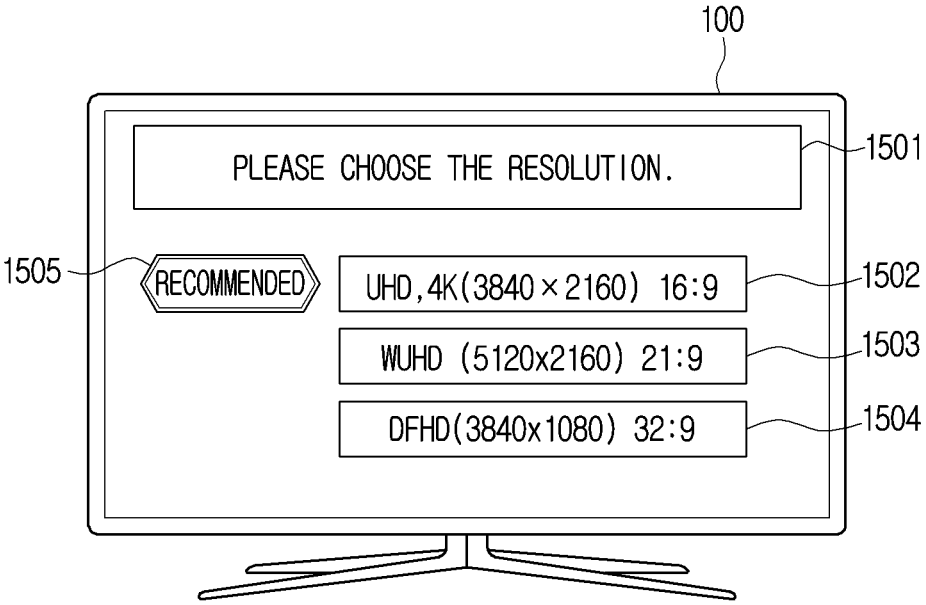
FIG. 15 is a diagram for illustrating a UI for a user to select a resolution according to an embodiment of the disclosure.

FIG. 15 is a diagram for illustrating a UI for a user to select a resolution according to an embodiment of the disclosure.

Referring to FIG. 15, the electronic apparatus 100 may display a screen for guiding a user to select a resolution. The electronic apparatus 100 may display information 1501 notifying that the screen currently displayed is a screen for selecting one resolution among the plurality of resolutions.

Unlike in the embodiment in FIG. 14, the plurality of resolutions may have ratios different from one another.

For example, the UI 1502 may include the acronym information (UHD), the size information (3840×2160), and the ratio information (16:9). Also, the UI 1503 may include the acronym information (WUHD), the size information (5120×2160), and the ratio information (21:9). Further, the UI 1504 may include the acronym information (double full high definition (DFHD)), the size information (3840×1080), and the ratio information (32:9).

Then, the electronic apparatus 100 may additionally display a UI 1505 for notifying an optimal resolution corresponding to the display 120 of the electronic apparatus 100 among the plurality of resolutions.

Figure 16:
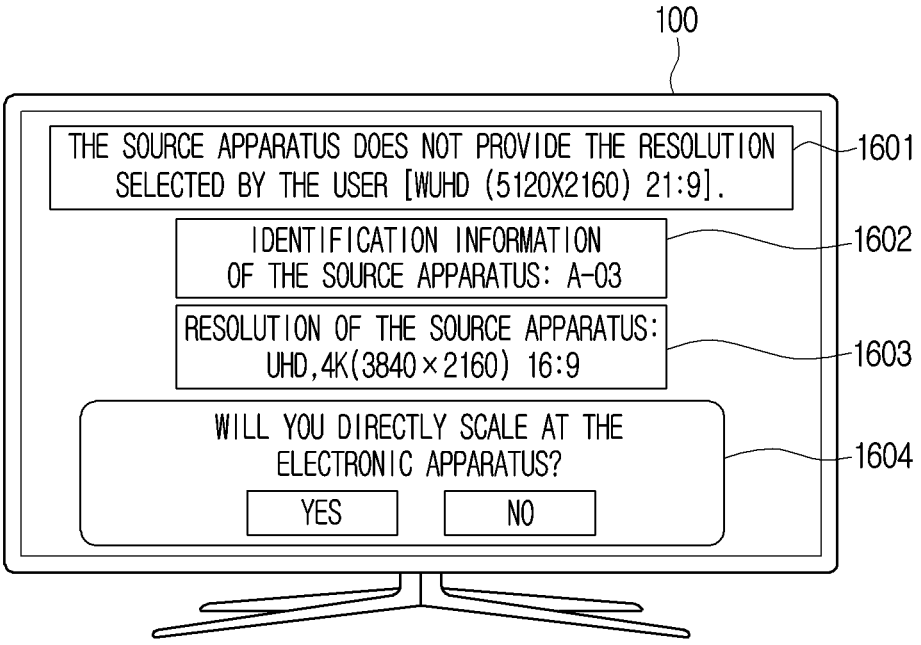
FIG. 16 is a diagram for illustrating a UI displayed in case the source apparatus cannot provide a resolution corresponding to a user input according to an embodiment of the disclosure.

FIG. 16 is a diagram for illustrating a UI displayed in case the source apparatus cannot provide a resolution corresponding to a user input according to an embodiment of the disclosure.

Referring to FIG. 16, if it is identified that the source apparatus 200 cannot provide the second resolution corresponding to the user input, the electronic apparatus 100 may display a UI 1601 including information for notifying the fact (the source apparatus 200 cannot provide the second resolution). Then, the electronic apparatus 100 may additionally display a UI 1602 including the identification information of the source apparatus 200 or a UI 1603 including information on resolutions that can be supported in the source apparatus 200. The resolution information may include at least one of the acronym information (e.g., UHD, 4K), the size information (e.g., 3840×2160), or the ratio information (e.g., 16:9).

Also, if it is identified that the source apparatus 200 cannot provide the second resolution corresponding to the user input, the electronic apparatus 100 may display a UI 1604 inquiring whether to perform a scaling operation directly at the electronic apparatus 100. If a user input for the electronic apparatus 100 to directly scale is received through the UI 1604, the electronic apparatus 100 may generate a content of the second resolution based on a content of the first resolution.

Figure 17:
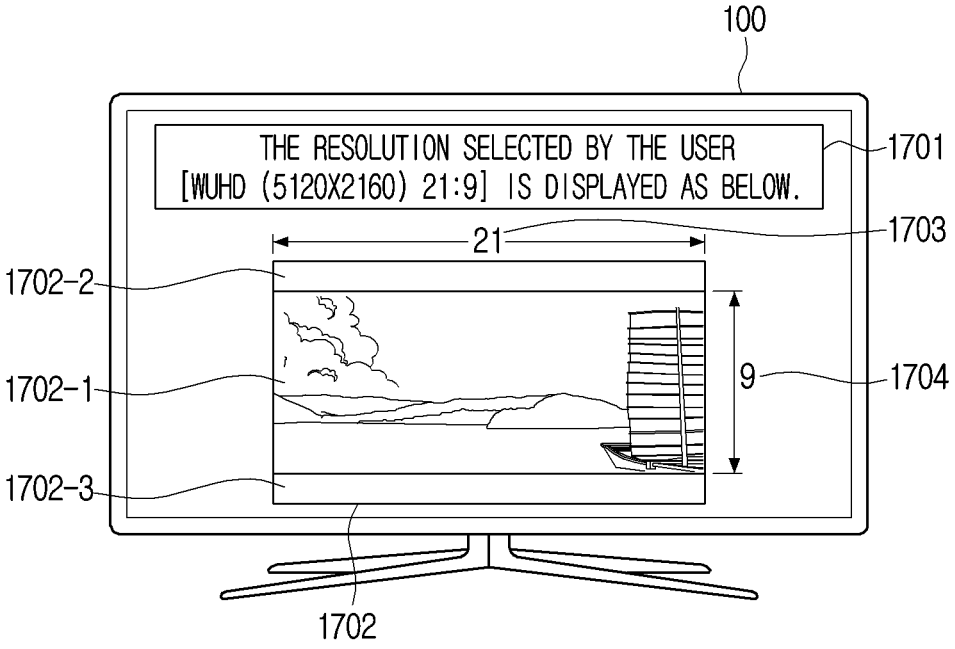
FIG. 17 is a diagram for illustrating an operation of displaying a thumbnail image related to a resolution corresponding to a user input according to an embodiment of the disclosure.

FIG. 17 is a diagram for illustrating an operation of displaying a thumbnail image related to a resolution corresponding to a user input according to an embodiment of the disclosure.

Referring to FIG. 17, if a user input for changing a resolution to the second resolution is received, a thumbnail image corresponding to the second resolution may be displayed. According to an embodiment, the thumbnail image may mean an image wherein a specific content is displayed in the second resolution on the display 120 of the electronic apparatus 100. According to another embodiment, the thumbnail image may mean an image wherein the content of the first resolution currently displayed is displayed in the second resolution on the display 120 of the electronic apparatus 100.

The electronic apparatus 100 may display a UI 1701 including information on the resolution currently selected by the user. Also, the UI 1701 may include at least one of the acronym information (e.g., WUHD), the size information (e.g., 5120×2160), or the ratio information (e.g., 21:9) of the resolution selected by the user.

Further, the electronic apparatus 100 may display a thumbnail image 1702 of the resolution selected by the user. The thumbnail image may include information on the horizontal ratio 1703 and information on the vertical ratio 1704.

The thumbnail image 1702 may be divided into an area wherein the content is displayed 1702-1 and areas wherein the content is not displayed 1702-2, 1702-3 according to the resolution.

Through the thumbnail image 1702, the user may intuitively recognize how the content is displayed on the screen actually displayed on the display 120 of the electronic apparatus 100.

Figure 18:
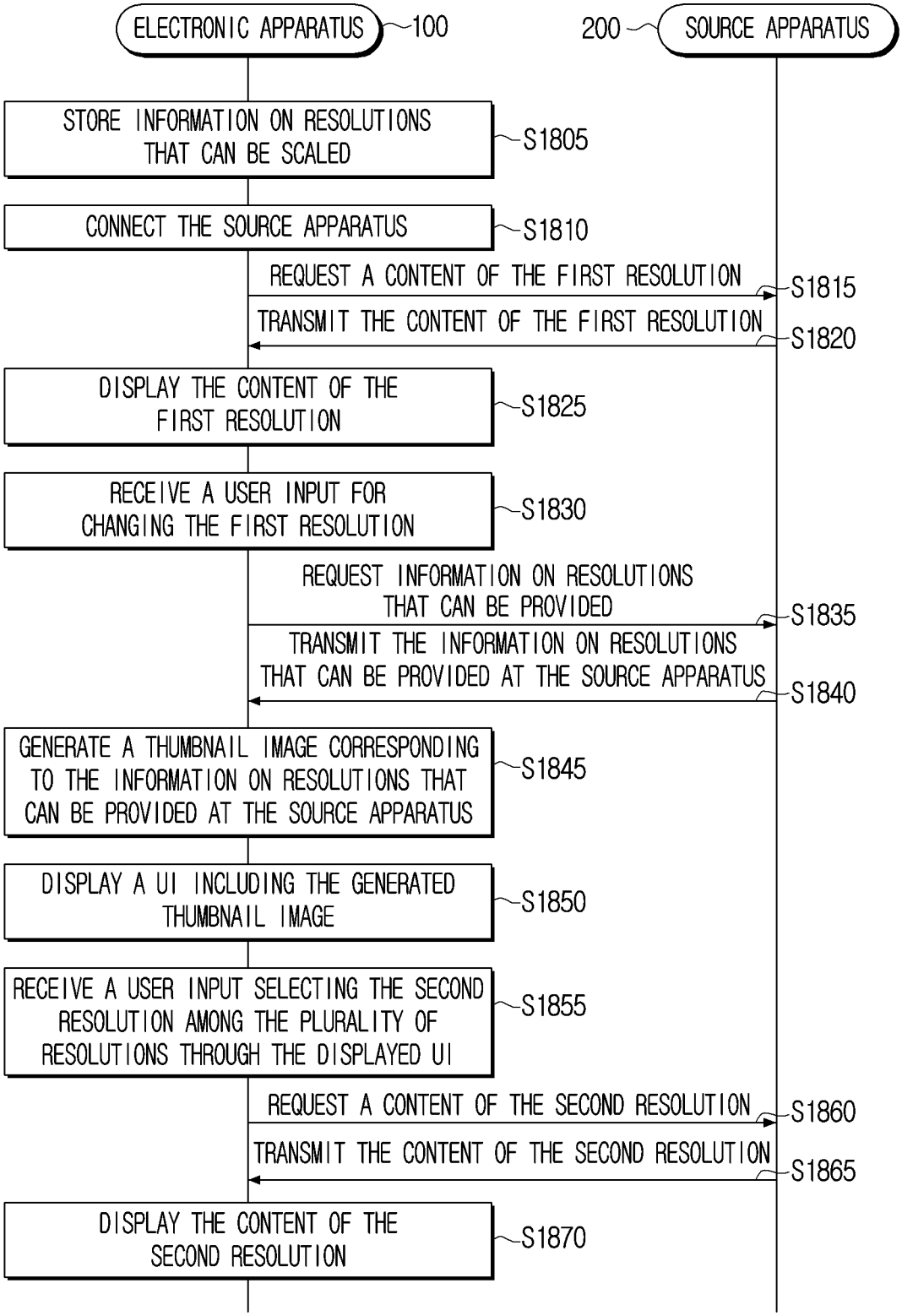
FIG. 18 is a flowchart for illustrating an operation of displaying a thumbnail image related to a resolution that can be provided through the source apparatus according to an embodiment of the disclosure.

FIG. 18 is a flowchart for illustrating an operation of displaying a thumbnail image related to a resolution that can be provided through the source apparatus according to an embodiment of the disclosure.

Referring to FIG. 18, the electronic apparatus 100 may store information on resolutions that can be directly scaled by the electronic apparatus 100 in the memory 140 in operation S1805. Then, the electronic apparatus 100 may be connected with the source apparatus 200 in operation S1810.

When the electronic apparatus 100 is connected with the source apparatus 200, the electronic apparatus 100 may request a content of the first resolution (or transmit a signal requesting a content of the first resolution) to the source apparatus 200 in operation S1815. The source apparatus 200 may transmit the content of the first resolution to the electronic apparatus 100 in response to the request of the electronic apparatus 100 in operation S1820. Then, the electronic apparatus 100 may display the content of the first resolution received from the source apparatus 200 in operation S1825. Then, the electronic apparatus 100 may receive a user input for changing the first resolution in operation S1830. The user input means a user input selecting the resolution setting menu for changing the first resolution, and it may not be a user input directly selecting a specific resolution.

When the user input selecting the setting menu for changing the resolution is received, the electronic apparatus 100 may request information on resolutions that can be provided by the source apparatus 200 in operation S1835. Then, the source apparatus 200 may transmit the information on resolutions that can be provided by the source apparatus 200 to the electronic apparatus 100 in response to the request received from the electronic apparatus 100 in operation S1840.

Then, the electronic apparatus 100 may generate a thumbnail image corresponding to the information on resolutions that can be provided that was received from the source apparatus 200 in operation S1845. Then, the electronic apparatus 100 may display a UI including the generated thumbnail image (1901 to 1905 in FIG. 19) in operation S1850. Then, the electronic apparatus 100 may receive a user input selecting the second resolution among the plurality of resolutions through the displayed UI in operation S1855. Then, when the user input selecting the second resolution is received, the electronic apparatus 100 may request the content of the second resolution to the source apparatus 200 in operation S1860. The source apparatus 200 may transmit the content of the second resolution to the electronic apparatus 100 in response to the request of the electronic apparatus 100 in operation S1865. Then, the electronic apparatus 100 may display the content of the second resolution received from the source apparatus 200 in operation S1870.

Figure 19:
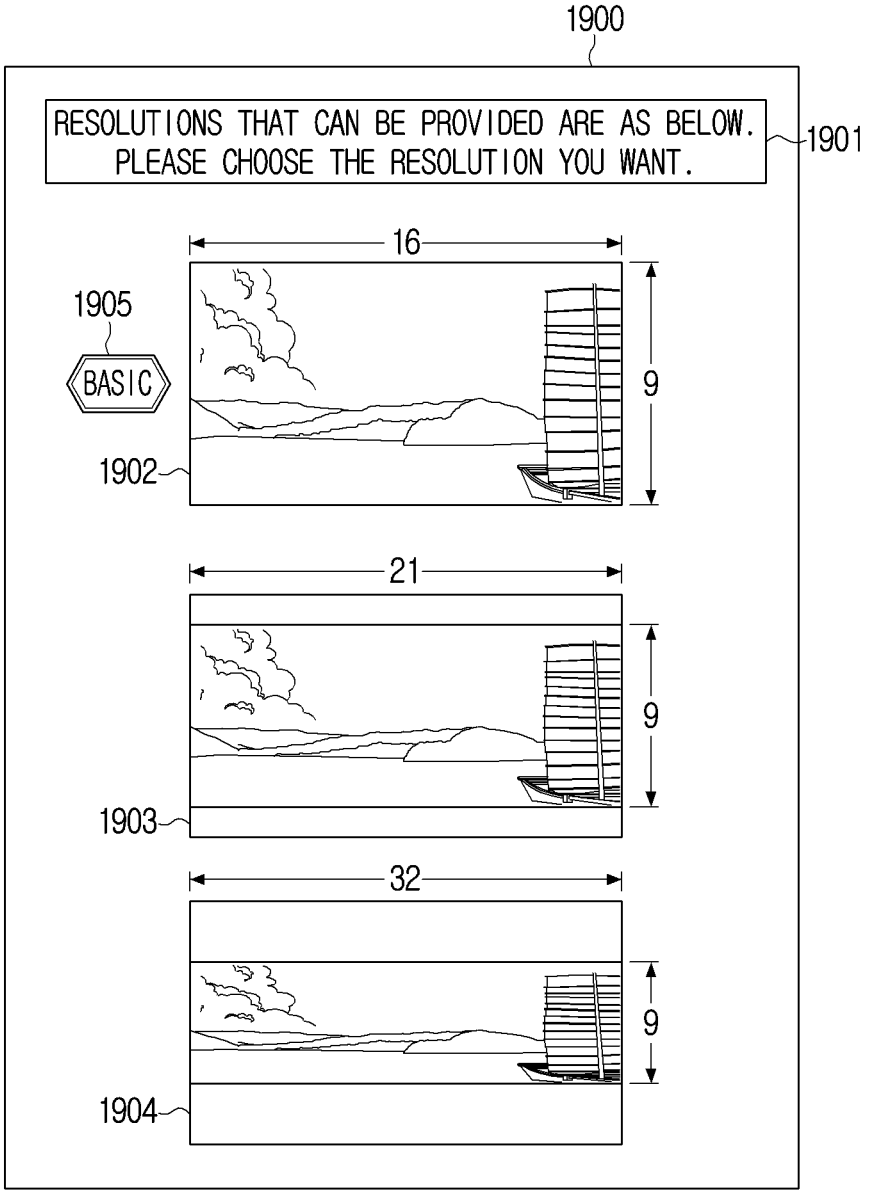
FIG. 19 is a diagram for illustrating an operation of displaying a thumbnail image related to a resolution according to an embodiment of the disclosure.

FIG. 19 is a diagram for illustrating an operation of displaying a thumbnail image related to a resolution according to an embodiment of the disclosure.

Referring to FIG. 19, the electronic apparatus 100 may display a screen 1900 including thumbnail images corresponding to a plurality of resolutions. According to an embodiment, the electronic apparatus 100 may acquire information on resolutions that can be provided at the source apparatus 200, and display thumbnail images corresponding to the acquired resolution information (operations S1835 to S1855 in FIG. 18). According to another embodiment, the electronic apparatus 100 may display thumbnail images corresponding to certain resolution information.

Specifically, the electronic apparatus 100 may display a UI 1910 including information guiding to select one resolution among the plurality of resolutions. Also, the electronic apparatus 100 may display thumbnail images 1902, 1903, 1904 corresponding to the plurality of respective resolutions for guiding a user to select. The plurality of respective thumbnail images 1902, 1903, 1904 may mean images predicting the components of the screen displayed on the display 120 of the electronic apparatus 100. Also, the plurality of thumbnail images 1902, 1903, 1904 may respectively include at least one of the acronym information, the size information, or the ratio information (e.g., 16:9, 21:9, 32:9).

The electronic apparatus 100 may additionally display a UI 1905 displaying a thumbnail image corresponding to the basic resolution among the plurality of thumbnail images.

The basic resolution can be easily identified through the notification UI 1905 for notifying that the resolution of the content currently displayed on the display 120 of the electronic apparatus 100 is the thumbnail image 1902. Then, the electronic apparatus 100 may display thumbnail images corresponding to the plurality of respective resolutions together, and thereby provide convenience such that the resolution to which the user wishes to change can be easily distinguished.

Figure 20:
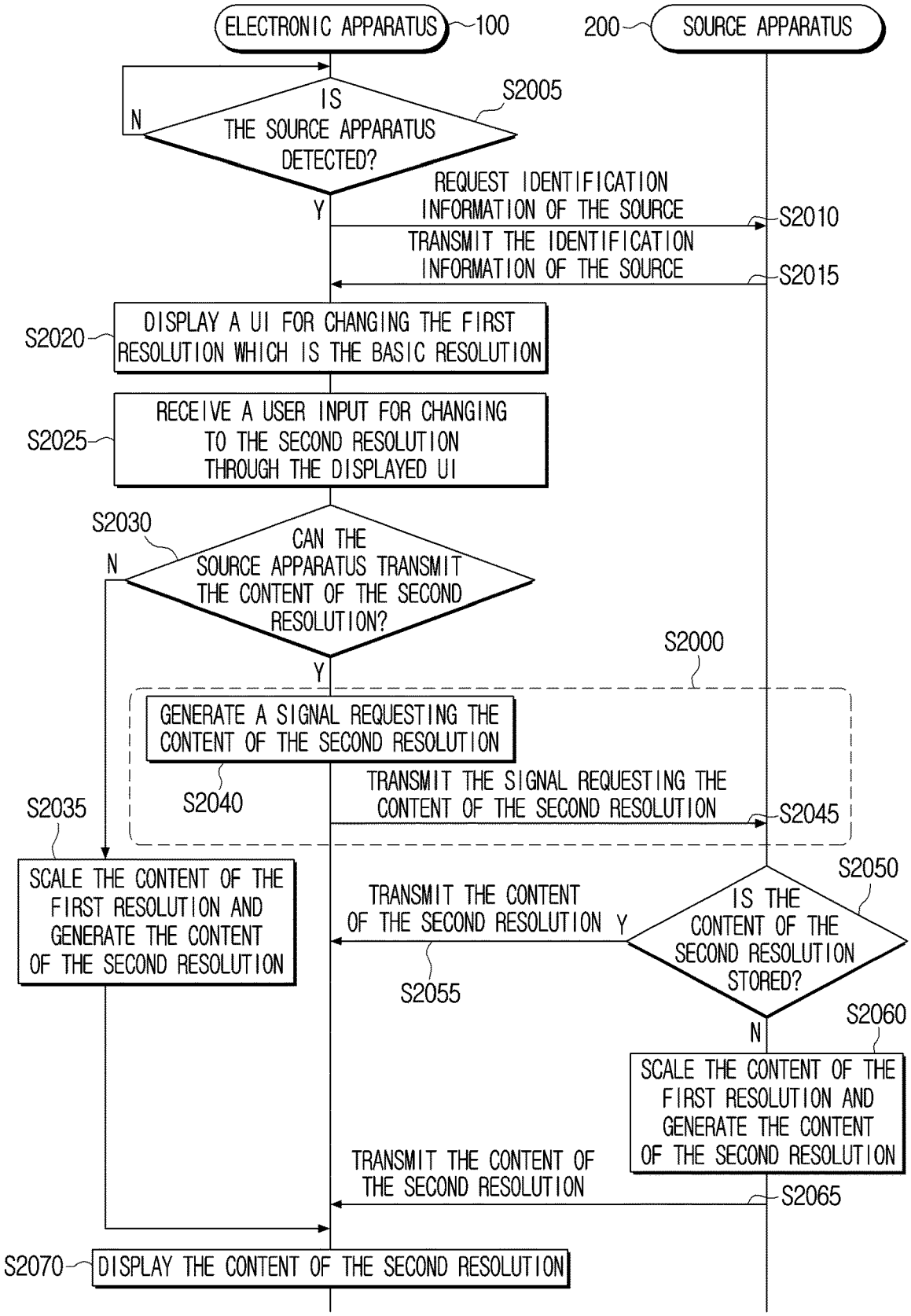
FIG. 20 is a flowchart for illustrating an operation of a user of selecting a resolution by using information of the source apparatus according to an embodiment of the disclosure.

FIG. 20 is a flowchart for illustrating an operation of a user of selecting a resolution by using information of the source apparatus according to an embodiment of the disclosure.

Referring to FIG. 20, the electronic apparatus 100 may detect whether the source apparatus 200 is connected with the electronic apparatus 100 in operation S2005. Specifically, the electronic apparatus 100 may determine whether the source apparatus 200 is connected through the input/output interface 110.

If it is determined that the source apparatus 200 is not connected in operation S2005-N, the electronic apparatus 100 may repetitively perform the operation of determining whether the source apparatus 200 is connected. If it is determined that the source apparatus 200 is connected in operation S2005-Y, the electronic apparatus 100 may request the identification information of the source apparatus 200 to the source apparatus 200 in operation S2010. Specifically, the electronic apparatus 100 may generate a signal requesting the identification information of the source apparatus 200, and transmit the generated signal to the source apparatus 200. The source apparatus 200 may transmit the identification information of the source apparatus 200 to the electronic apparatus 100 in response to the request for the identification information received from the electronic apparatus 100 in operation S2015.

Then, when the identification information of the source apparatus 200 is received, the electronic apparatus 100 may display a UI for changing the first resolution which is the basic resolution in operation S2020. Then, the electronic apparatus 100 may receive a user input for changing the resolution to the second resolution through the displayed UI in operation S2025.

The electronic apparatus 100 may identify whether the source apparatus 200 can transmit a content of the second resolution in operation S2030. If it is identified that the source apparatus 200 cannot transmit a content of the second resolution in operation S2030-N, the electronic apparatus 100 may directly scale the content of the first resolution and generate the content of the second resolution in operation S2035. Then, the electronic apparatus 100 may display the content of the second resolution in operation S2070.

Meanwhile, if it is identified that the source apparatus 200 can transmit a content of the second resolution in operation S2030-Y, the electronic apparatus 100 may perform an operation S2000 for receiving the content of the second resolution. The operation for receiving the content of the second resolution according to an embodiment may include an operation S2040 of the electronic apparatus 100 of generating a signal requesting the content of the second resolution, and an operation S2045 of transmitting the generated signal requesting the content of the second resolution to the source apparatus 200. Meanwhile, the operation S2000 may be performed while being replaced by the operation S1200 in FIG. 12.

The signal requesting the content of the second resolution may mean a hot plug detect signal. The electronic apparatus 100 may change the hot plug detect signal from a low state to a high state. Also, the electronic apparatus 100 may make the changed hot plug detect signal transmitted to the source apparatus 200 or make the changed hot plug detect signal read by the source apparatus 200.

Also, when the signal requesting the content of the second resolution is received, the source apparatus 200 may identify whether the content of the second resolution is stored in the memory of the source apparatus 200 in operation S2050. If the content of the second resolution is stored in the memory of the source apparatus 200 in operation S2050-Y, the source apparatus 200 may transmit the stored content of the second resolution to the electronic apparatus 100 in operation S2055.

Further, if the content of the second resolution is not stored in the memory of the source apparatus 200 in operation S2050-N, the source apparatus 200 may scale the content of the first resolution and generate the content of the second resolution in operation S2060. Then, the source apparatus 200 may transmit the generated content of the second resolution to the electronic apparatus 100 in operation S2065. Then, the electronic apparatus 100 may receive the content of the second resolution from the source apparatus 200. Then, the electronic apparatus 100 may display the content of the second resolution in operation S2070.

Figure 21:
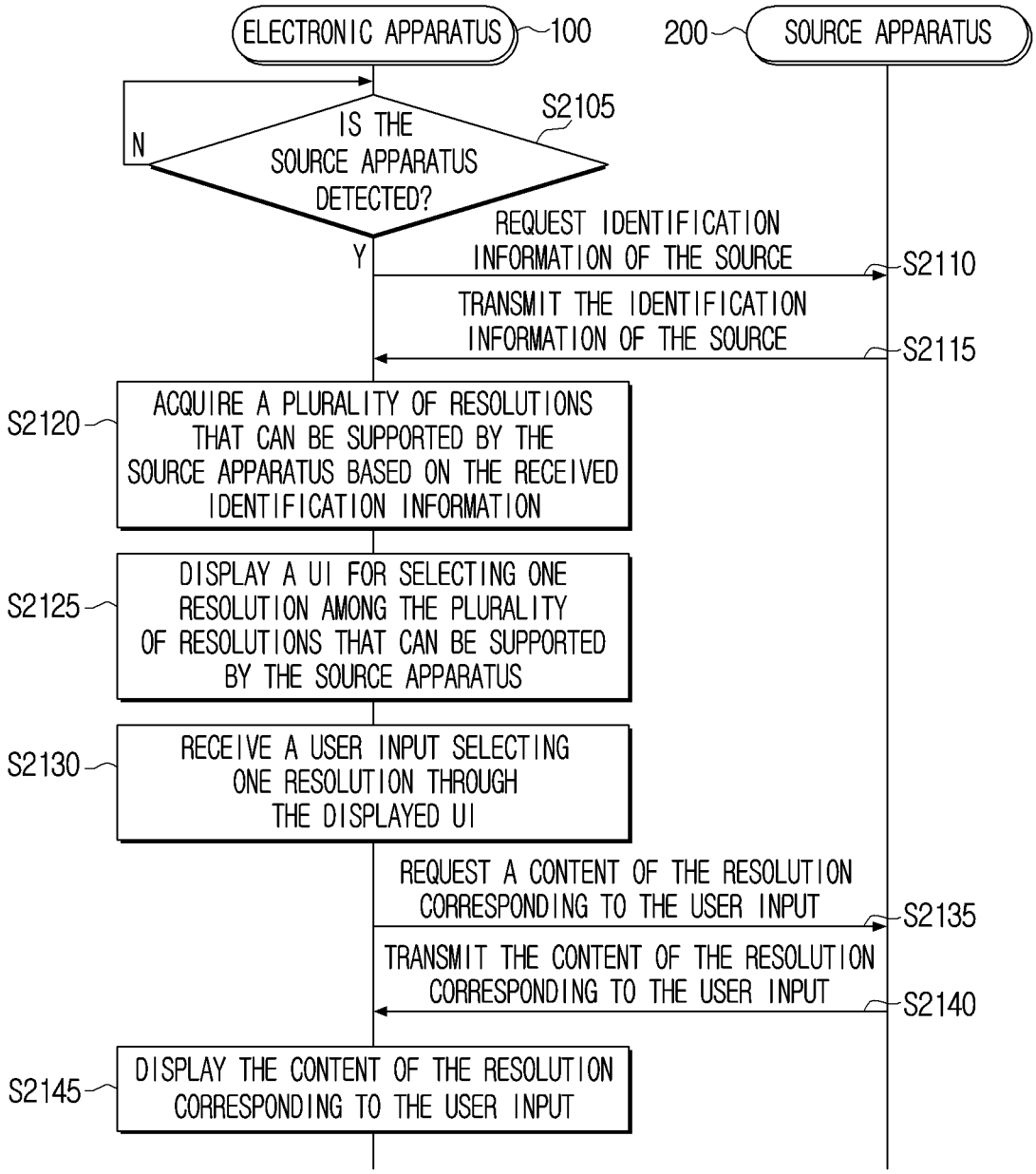
FIG. 21 is a flowchart for illustrating an operation of a user of selecting a resolution by using information of the source apparatus according to an embodiment of the disclosure.

FIG. 21 is a flowchart for illustrating an operation of a user of selecting a resolution by using information of the source apparatus according to an embodiment of the disclosure.

Referring to FIG. 21, the electronic apparatus 100 may detect whether the source apparatus 200 is connected with the electronic apparatus 100 in operation S2105. Specifically, the electronic apparatus 100 may determine whether the source apparatus 200 is connected through the input/output interface 110.

If it is determined that the source apparatus 200 is not connected in operation S2105-N, the electronic apparatus 100 may repetitively perform the operation of determining whether the source apparatus 200 is connected. If it is determined that the source apparatus 200 is connected in operation S2105-Y, the electronic apparatus 100 may request the identification information of the source apparatus 200 to the source apparatus 200 in operation S2110. Specifically, the electronic apparatus 100 may generate a signal requesting the identification information of the source apparatus 200, and transmit the generated signal to the source apparatus 200. The source apparatus 200 may transmit the identification information of the source apparatus 200 to the electronic apparatus 100 in response to the request for the identification information received from the electronic apparatus 100 in operation S2115.

When the identification information of the source apparatus 200 is received from the source apparatus 200, the electronic apparatus 100 may acquire a plurality of resolutions (or information on resolutions) that can be supported by the source apparatus 200 based on the identification information of the source apparatus 200 in operation S2120. According to an embodiment, the electronic apparatus 100 may store a mapping table wherein identification information of a plurality of source apparatuses and a plurality of resolutions corresponding to the plurality of identification information are mapped. Accordingly, when the electronic apparatus 100 receives the identification information of the source apparatuses, the electronic apparatus 100 may identify which resolutions are supported (or provided) by the source apparatus.

According to another embodiment, the electronic apparatus 100 may receive resolutions (or information on resolutions) that can be supported (or provided) by the source apparatus 200 directly from the source apparatus 200. In the operations S2110 and S2115, only the features of requesting and transmitting identification information are disclosed, but additionally, the electronic apparatus 100 may request the information on resolutions that can be supported by the source apparatus 200 to the source apparatus 200, and the source apparatus 200 may transmit the information on resolutions that can be supported to the electronic apparatus 100.

The electronic apparatus 100 may display a UI for selecting one resolution among the plurality of resolutions that can be supported by the source apparatus in operation S2125. The UI may be the UI disclosed in FIG. 14 or FIG. 15. Also, the electronic apparatus 100 may additionally display a separate UI (e.g., 1405 in FIG. 14 or 1505 in FIG. 15) in an item corresponding to the recommended resolution among the plurality of resolutions.

Then, the electronic apparatus 100 may receive a user input selecting one resolution among the plurality of resolutions through the displayed UI in operation S2130. Then, the electronic apparatus 100 may request a content of the resolution corresponding to the user input to the source apparatus 200 in operation S2135. Specifically, the electronic apparatus 100 may generate a signal for requesting a content of the resolution corresponding to the user input, and transmit the generated signal to the source apparatus 200.

Then, the source apparatus 200 may transmit the content of the resolution corresponding to the user input to the electronic apparatus 100 in response to the request received from the electronic apparatus 100 in operation S2140. Then, the electronic apparatus 100 may display the received content of the resolution corresponding to the user input in operation S2145.

Figure 22:
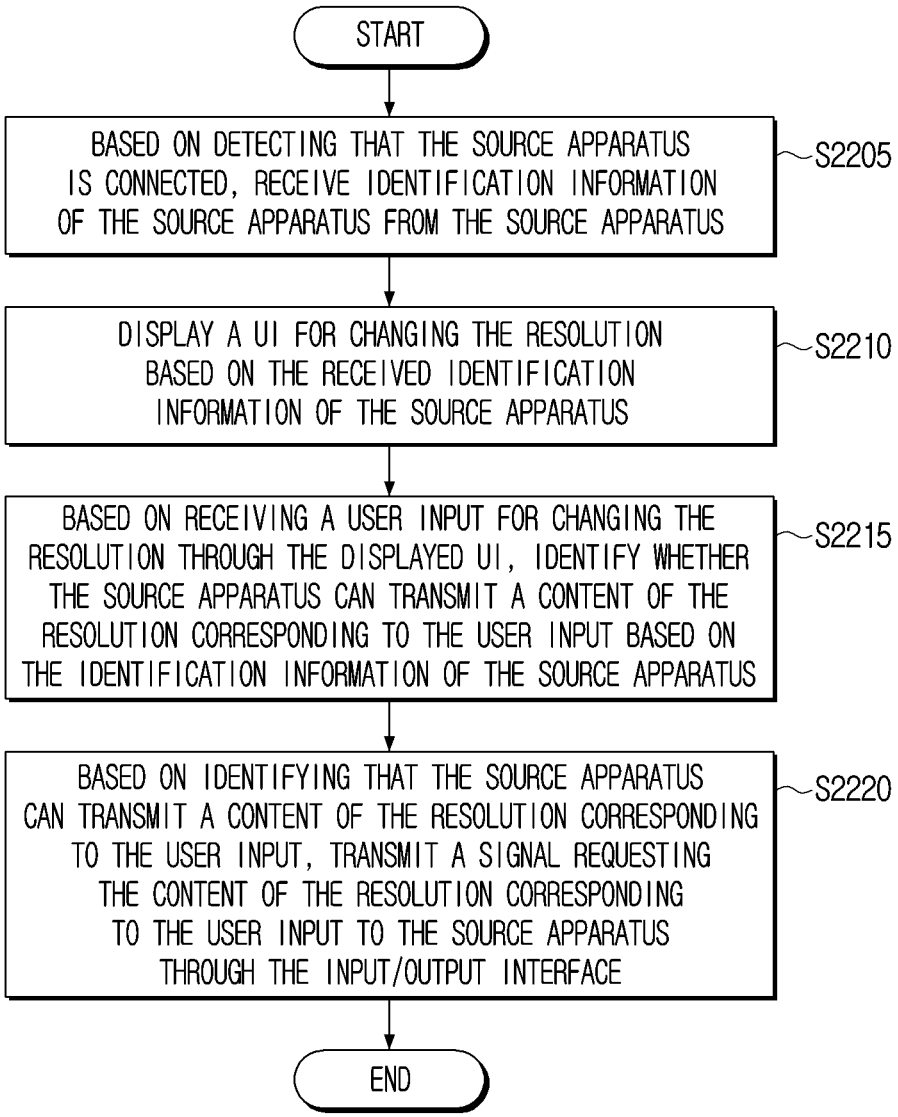
FIG. 22 is a flowchart for illustrating a controlling method of an electronic apparatus according to an embodiment of the disclosure.

FIG. 22 is a flowchart for illustrating a controlling method of an electronic apparatus according to an embodiment of the disclosure.

Referring to FIG. 22, a controlling method of the electronic apparatus 100 connected to the source apparatus 200 includes the steps of displaying a content received from the source apparatus 200 at operation S2205, based on receiving a user input for changing the resolution of the received content, identifying whether the source apparatus 200 can transmit a content of the resolution corresponding to the user input based on the identification information of the source apparatus 200 at operation S2210, based on identifying that the source apparatus 200 cannot transmit a content of the resolution corresponding to the user input, scaling the content received from the source apparatus 200 to the resolution corresponding to the user input at operation S2215, and displaying the scaled content at operation S2220.

Meanwhile, the controlling method may further include the steps of, based on identifying that the source apparatus 200 can transmit a content of the resolution corresponding to the user input, changing extended display identification data (EDID) information corresponding to the electronic apparatus 100 based on the resolution corresponding to the user input.

Meanwhile, the controlling method may further include the steps of, based on the EDID information changing, transmitting a signal for notifying that the EDID information was changed to the source apparatus 200, receiving a content corresponding to the changed EDID information from the source apparatus 200, and displaying the content received from the source apparatus 200.

Meanwhile, the signal for notifying that the EDID information was changed may be a signal changing a hot plug detect signal from a low state to a high state.

Meanwhile, in the step of identifying whether the source apparatus 200 can transmit a content of the resolution corresponding to the user input at operation S2010, resolution information corresponding to the identification information of the source apparatus 200 may be identified based on a table wherein identification information of a plurality of source apparatuses 200 stored in the electronic apparatus 100 and resolution information corresponding to the respective identification information are mapped, and it may be identified whether the source apparatus 200 can transmit a content of the resolution corresponding to the user input based on the identified resolution information.

Meanwhile, the input/output interface 110 of the electronic apparatus 100 may be a high definition multimedia interface (HDMI). Meanwhile, the controlling method may further include the step of, based on the source apparatus 200 being connected through the input/output interface 110, acquiring the identification information of the source apparatus 200 from the source apparatus 200.

Meanwhile, the controlling method may further include the steps of identifying whether the source apparatus 200 can scale a content based on the identification information of the source apparatus 200, and based on identifying that the source apparatus 200 can scale a content, transmitting a signal requesting the content of the resolution corresponding to the user input to the source apparatus 200, and based on identifying that the source apparatus 200 cannot scale a content, scaling the content received from the source apparatus 200 to the resolution corresponding to the user input.

Meanwhile, the UI may be a UI for selecting one resolution among a plurality of resolutions, and in the step of identifying whether the source apparatus 200 can transmit a content of the resolution corresponding to the user input, based on receiving a user input selecting one resolution through the displayed UI, it may be identified whether the source apparatus 200 can transmit a content of the resolution corresponding to the user input based on the identification information of the source apparatus 200.

Meanwhile, the controlling method may further include the steps of identifying a plurality of resolutions that can be displayed on the display 120 based on resolution information of the display 120 included in the electronic apparatus 100, and displaying the UI for selecting one resolution among the plurality of identified resolutions.

Meanwhile, the controlling method may further include the step of, based on identifying that the source apparatus 200 cannot transmit a content of the resolution corresponding to the user input, displaying a UI including at least one of information notifying that the source apparatus 200 cannot transmit a content of the resolution corresponding to the user input, the identification information of the source apparatus 200, the resolution information of the source apparatus 200, or information for guiding such that the content received from the source apparatus 200 is scaled to the resolution corresponding to the user input at the electronic apparatus 100.

Meanwhile, the controlling method of an electronic apparatus as in FIG. 22 may be executed in an electronic apparatus having the configuration as in FIG. 4 or FIG. 5, and it may also be executed in electronic apparatuses having other configurations.

Meanwhile, the methods according to the aforementioned various embodiments of the disclosure may be implemented in forms of applications that can be installed on conventional electronic apparatuses.

Also, the methods according to the aforementioned various embodiments of the disclosure may be implemented just by software upgrade, or hardware upgrade of conventional electronic apparatuses.

In addition, the aforementioned various embodiments of the disclosure may be performed through an embedded server provided on an electronic apparatus, or an external server of at least one of an electronic apparatus or a display apparatus.

Meanwhile, according to an embodiment of the disclosure, the aforementioned various embodiments may be implemented as software including instructions stored in machine-readable storage media, which can be read by machines (e.g.: computers). The machines refer to apparatuses that call instructions stored in a storage medium, and can operate according to the called instructions, and the apparatuses may include an electronic apparatus according to the aforementioned embodiments. In case an instruction is executed by a processor, the processor may perform a function corresponding to the instruction by itself, or by using other components under its control. An instruction may include a code that is generated or executed by a compiler or an interpreter. A storage medium that is readable by machines may be provided in the form of a non-transitory storage medium. The term 'non-transitory' only means that a storage medium does not include signals, and is tangible, but does not indicate whether data is stored in the storage medium semi-permanently or temporarily.

Also, according to an embodiment of the disclosure, the methods according to the aforementioned various embodiments may be provided while being included in a computer program product. The computer program product can be traded between a seller and a purchaser as a commodity. The computer program product may be distributed in the form of a machine-readable storage medium (e.g.: a compact disc read only memory (CD-ROM)), or distributed online through an application store (e.g.: PLAY STORE™). In the case of online distribution, at least a portion of the computer program product may be at least temporarily stored in a storage medium such as the server of the manufacturer, the server of the application store, or the memory of the relay server, or temporarily generated.

Further, each of the components (e.g.: a module or a program) according to the aforementioned various embodiments may consist of a singular object or a plurality of objects. Also, among the aforementioned corresponding sub components, some sub components may be omitted, or other sub components may be further included in the various embodiments. Alternatively or additionally, some components (e.g.: a module or a program) may be integrated as an object, and perform functions performed by each of the components before integration identically or in a similar manner. Also, operations performed by a module, a program, or other components according to the various embodiments may be executed sequentially, in parallel, repetitively, or heuristically. Or, at least some of the operations may be executed in a different order or omitted, or other operations may be added.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic apparatus comprising:

an input/output interface connected to a source apparatus;

a display; and a processor configured to:

based on detecting that the source apparatus is connected through the input/output interface, receive identification information of the source apparatus from the source apparatus, based on the received identification information of the source apparatus, control the display to display a user interface (UI) for changing a resolution, based on receiving a user input for changing a resolution through the displayed UI, identify whether the source apparatus can transmit a content of the resolution corresponding to the user input based on the received identification information of the source apparatus and resolution information corresponding to the received identification information, and based on identifying that the source apparatus can transmit a content of the resolution corresponding to the user input, transmit a signal requesting the content of the resolution corresponding to the user input to the source apparatus through the input/output interface.

2. The electronic apparatus of claim 1, further comprising:

a memory storing extended display identification data (EDID) information corresponding to the electronic apparatus, wherein the processor is further configured to:

based on identifying that the source apparatus can transmit a content of the resolution corresponding to the user input, change the EDID information based on the resolution corresponding to the user input, and based on identifying that the source apparatus cannot transmit a content of the resolution corresponding to the user input, scale the content received from the source apparatus to the resolution corresponding to the user input, and control the display to display the scaled content.

3. The electronic apparatus of claim 2, wherein the processor is further configured to:

based on the EDID information changing, transmit a signal for notifying that the EDID information was changed to the source apparatus, receive a content corresponding to the changed EDID information from the source apparatus, and control the display to display the content received from the source apparatus.

4. The electronic apparatus of claim 3, wherein the transmitted signal for notifying that the EDID information was changed is a signal changing a hot plug detect signal from a low state to a high state.

5. The electronic apparatus of claim 1, further comprising:

a memory storing a table, the table mapping identification information of a plurality of source apparatuses and resolution information corresponding to the respective identification information, wherein the processor is further configured to:

identify the resolution information corresponding to the received identification information of the source apparatus based on the table stored in the memory, and identify whether the source apparatus can transmit a content of the resolution corresponding to the user input based on the identified resolution information.

6. The electronic apparatus of claim 5, wherein the input/output interface is a high definition multimedia interface (HDMI), and wherein the processor is further configured to:

based on the source apparatus being connected through the input/output interface, acquire the identification information of the source apparatus from the source apparatus.

7. The electronic apparatus of claim 1, wherein the processor is further configured to:

identify whether the source apparatus can scale a content based on the received identification information of the source apparatus, based on identifying that the source apparatus can scale a content, transmit a signal requesting the content of the resolution corresponding to the user input to the source apparatus, and based on identifying that the source apparatus cannot scale a content, scale the content received from the source apparatus to the resolution corresponding to the user input.

8. The electronic apparatus of claim 1, wherein the UI is a UI for selecting one resolution among a plurality of resolutions, and wherein the processor is further configured to:

based on receiving a user input selecting one resolution through the displayed UI, identify whether the source apparatus can transmit a content of the resolution corresponding to the user input based on the received identification information of the source apparatus.

9. The electronic apparatus of claim 8, wherein the processor is further configured to:

identify a plurality of resolutions that can be displayed on the display based on resolution information of the display, and control the display to display the UI for selecting one resolution among the plurality of identified resolutions.

10. The electronic apparatus of claim 8, wherein the processor is further configured to:

based on identifying that the source apparatus cannot transmit a content of the resolution corresponding to the user input, control the display to display a UI comprising at least one of information notifying that the source apparatus cannot transmit a content of the resolution corresponding to the user input, the received identification information of the source apparatus, resolution information of the source apparatus, or information for guiding such that the content received from the source apparatus is scaled to the resolution corresponding to the user input at the electronic apparatus.

11. A controlling method of an electronic apparatus connected to a source apparatus, the controlling method comprising:

based on detecting that the source apparatus is connected, receiving identification information of the source apparatus from the source apparatus;

based on the received identification information of the source apparatus, displaying a user interface (UI) for changing a resolution;

based on receiving a user input for changing a resolution through the displayed UI, identifying whether the source apparatus can transmit a content of the resolution corresponding to the user input based on the received identification information of the source apparatus and resolution information corresponding to the received identification information; and based on identifying that the source apparatus can transmit a content of the resolution corresponding to the user input, transmitting a signal requesting the content of the resolution corresponding to the user input to the source apparatus through an input/output interface.

12. The controlling method of claim 11, further comprising:

based on identifying that the source apparatus can transmit a content of the resolution corresponding to the user input, changing extended display identification data (EDID) information corresponding to the electronic apparatus based on the resolution corresponding to the user input; and based on identifying that the source apparatus cannot transmit a content of the resolution corresponding to the user input, scaling the content received from the source apparatus to the resolution corresponding to the user input, and displaying the scaled content.

13. The controlling method of claim 12, further comprising:

based on the EDID information changing, transmitting a signal for notifying that the EDID information was changed to the source apparatus;

receiving a content corresponding to the changed EDID information from the source apparatus; and displaying the content received from the source apparatus.

14. The controlling method of claim 13, wherein the transmitted signal for notifying that the EDID information was changed is a signal changing a hot plug detect signal from a low state to a high state.

15. The controlling method of claim 14, wherein the hot plug detect signal indicates whether an HDMI cable is connected or released.

16. The controlling method of claim 15, wherein, based on the hot plug detect signal transitioning to a predetermined voltage, the source apparatus recognizes that the HDMI cable is connected and requests the EDID information from the electronic apparatus.

17. The controlling method of claim 11, wherein the identifying whether the source apparatus can transmit a content of the resolution corresponding to the user input comprises:

identifying the resolution information corresponding to the received identification information of the source apparatus based on a table, the table mapping identification information of a plurality of source apparatuses stored in the electronic apparatus and resolution information corresponding to the respective identification information; and identifying whether the source apparatus can transmit a content of the resolution corresponding to the user input based on the identified resolution information.

18. The controlling method of claim 11, wherein the UI comprises a UI for selecting one resolution out of a plurality of listed resolutions, the UI displaying a thumbnail next to each of the plurality of listed resolutions.

19. The controlling method of claim 18, wherein each thumbnail displays ratio information of a corresponding resolution.

* * * * *